US008397444B2

(12) United States Patent
Reaveley et al.

(10) Patent No.: US 8,397,444 B2
(45) **Date of Patent: *Mar. 19, 2013**

(54) PERFORATED PLATE SEISMIC DAMPER

(75) Inventors: Larry D. Reaveley, Salt Lake City, UT (US); Tyler J. Ross, Pleasant View, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 767 days.

This patent is subject to a terminal disclaimer.

(21) Appl. No.: 12/611,351

(22) Filed: Nov. 3, 2009

(65) Prior Publication Data

US 2010/0107519 A1 May 6, 2010

Related U.S. Application Data

(63) Continuation-in-part of application No. 12/116,061, filed on May 6, 2008, now Pat. No. 8,099,914, which is a continuation-in-part of application No. 11/928,622, filed on Oct. 30, 2007, now Pat. No. 8,037,647.

(60) Provisional application No. 60/863,561, filed on Oct. 30, 2006.

(51) Int. Cl.
*E04B 1/98* (2006.01)

(52) U.S. Cl. ..... 52/167.3; 52/167.9

(58) Field of Classification Search ..... 52/167.3, 52/167.4, 167.9

See application file for complete search history.

(56) References Cited

U.S. PATENT DOCUMENTS

| | | | |
|---|---|---|---|
| 4,027,389 | A | 6/1977 | Atchisson |
| 4,373,649 | A | 2/1983 | Ninomiya |
| 4,480,731 | A | 11/1984 | Izeki |
| 4,502,219 | A | 3/1985 | Hibben |
| 4,606,125 | A | 8/1986 | Jensen |
| 4,765,628 | A | 8/1988 | Jensen |
| 4,805,359 | A | 2/1989 | Miyake |
| 4,807,362 | A | 2/1989 | Prentice |
| 5,161,655 | A | 11/1992 | Shimoda |
| 5,509,238 | A | 4/1996 | Scalfati |
| 6,243,998 | B1 | 6/2001 | MacKarvich |
| 6,389,761 | B1 | 5/2002 | McKinnon |
| 6,651,395 | B2 | 11/2003 | Capra |
| D510,009 | S | 9/2005 | Lee |
| D557,330 | S | 12/2007 | Parikh |
| 2005/0155483 | A1 | 7/2005 | Anderson |
| 2006/0150538 | A1 | 7/2006 | Thomas |
| 2008/0022610 | A1 | 1/2008 | Gjelsvik |
| 2010/0107519 | A1 | 5/2010 | Reaveley |

OTHER PUBLICATIONS

U.S. Appl. No. 11/928,622, filed Nov. 24, 2010, Office Action.
U.S. Appl. No. 12/116,061, filed Nov. 24, 2010, Office Action.
U.S. Appl. No. 11/928,622, filed Jun. 28, 2011, Notice of Allowance.
U.S. Appl. No. 12/116,061, filed Aug. 18, 2011, Notice of Allowance.

*Primary Examiner* — William Gilbert
*Assistant Examiner* — Alp Akbasli
(74) *Attorney, Agent, or Firm* — Workman Nydegger

(57) ABSTRACT

Disclosed are apparatus and systems for absorbing seismic energy through non-linear yielding as a structure experiences lateral displacement. A seismic damper according to embodiments of the present invention includes at least one flat plate which can be perforated to include a plurality of apertures and/or cut-outs. One or more interior apertures are formed in the plate, and cut-outs may be formed along outer edges. External nodes are defined between the apertures and the cut-outs and stresses focus on the nodes to reduce non-linear displacement of a brace system to which the seismic damper is attached. One or more tension straps can be attached to the flat plate. Tension straps can be rotated relative to each other. Multiple tension straps may also be on the same surface. Multiple tension straps on the same surface may be nested and parallel.

20 Claims, 14 Drawing Sheets

PERFORATED PLATE SEISMIC DAMPER

CROSS-REFERENCE TO RELATED APPLICATIONS

The present application is a continuation-in-part of, and claims the benefit of, and priority to, U.S. patent application Ser. No. 12/116,061, filed on May 6, 2008, and entitled "Perforated Plate Seismic Damper", which is a continuation-in-part of U.S. patent application Ser. No. 11/928,622, filed on Oct. 30, 2007, and entitled "Perforated Plate Seismic Damper," which claims the benefit of, and priority to, U.S. Provisional Application Ser. No. 60/863,561, filed on Oct. 30, 2006, and entitled "Perforated Plate Seismic Damper." Each of the foregoing applications is expressly incorporated herein by this reference in its entirety.

BACKGROUND OF THE INVENTION

1. The Field of the Invention

Exemplary embodiments of the invention relate to the field of energy absorption. More particularly, the invention relates to apparatus and systems for absorbing and dissipating seismic energy.

2. The Relevant Technology

Building codes are set in place so that buildings, whether residential or commercial structures, are designed and constructed to have in place a minimum set of standards designed to allow the building to withstand tension and compression cycles. Such cycles may come about from any of a variety of different sources. For instance, such tension and compression cycles may be induced by earthquakes, winds, and other natural and/or man-made phenomena. For example, when an earthquake or similar event occurs, energy from the earthquake is transferred to the structure, causing the structure to oscillate, thereby also causing the structure and its support members to undergo a number of tensile and compressive cycles. Hopefully, in such an energy-inducing event (i.e. if the building codes are met, and the energy-inducing event is of a size less than the maximum for which the building codes were designed), the structure can withstand the tensile and compressive cycles without buckling or excessive deformation.

To meet these building codes, a frame-based structure can be designed and constructed with stiff cross-members which act as braces to withstand any compressive and tensile cycles occurring as a result of linear displacement. Typically, building code standards do not, however, require structures to exhibit high-energy dissipating characteristics that would allow for multiple cycles of non-linear displacement. Thus, a large earthquake, which may cause the structure to undergo non-linear displacement, may cause significant damage to the buildings despite compliance with the building codes. In particular, such structures are vulnerable to deformation and buckling in the event of a large earthquake or similar energy-inducing event which causes non-linear displacement and/or stress cycles above and beyond the minimum stresses that compliance with the building codes should withstand. Moreover, such problems are magnified in structures which have multiple stories as inter-story drift can be created which causes the stories to shift relative to each other.

To prevent or reduce the damage in the event of a major seismic event, structural dampers may be used which absorb high amounts of energy generated by the seismic event so as to reduce the displacement of the structure. In some cases, this damage is mitigated by limiting the structure to linear displacement where the stiff-cross members and bracing structures are less subject to deformation and buckling.

Exemplary structural dampers that can be used in this manner include various fluid-based and visco-elastic dampers. Each of these types of dampers are useful in that their components absorb the energy applied by a seismic event and thereby reduce structural displacement. Nevertheless, such damping structures are also very specialized and expensive. As a result, such devices are typically limited to high-cost applications which require high-performance capabilities.

Accordingly, what are desired are apparatus and systems which provide a low-cost structural damper which can absorb significant amounts of energy to reduce displacement and damage to a structure. It is also desired to provide structural damping apparatus and systems which can be implemented in connection with new construction or which can be efficiently installed to retrofit and rehabilitate existing structures. Moreover, such dampers may be used for many different applications in addition to seismic activities and can, for example, dissipate energy transferred to a structure through wind, explosive blasts, and other energy events.

BRIEF SUMMARY OF THE INVENTION

Exemplary embodiments of the invention relate to a seismic damper which, when fixed to a structure, can absorb significant amounts of energy through deformation, thereby reducing the overall displacement and damage to a structure. A seismic damper of the system can include a single plate which is attached to two or more cross-members of a support structure. The single plate can include fuse areas configured to deform as a structure experiences seismic accelerations, and which can accumulate such deformation through multiple cycles. In embodiments in which a single plate damper is used, the damper can be simply and efficiently fabricated at low cost, thereby also allowing the damper to be cost efficiently replaced after excessive deformation or to be cost effectively installed in retrofit applications.

According to one embodiment of the present invention, a seismic damper is constructed to include a substantially flat plate. The substantially flat plate can also include a plurality of nodes along each side of the flat plate, and a plurality of tabs at each corner of the plurality of tabs, such that the tabs intersect at the nodes. The nodes can further be defined as the portions of the flat plate situated between an aperture within the flat plate and each of a plurality of cut-outs formed along each which has one or more apertures formed in the flat plate and one or more cut-outs formed along an outer edge of each side of the flat plate. Such a flat plate can be of any suitable shape and can be, for example, substantially square, having a thickness substantially less than the length of each of the four sides of the square.

The aperture and/or cut-outs can also have any suitable shape or size. For instance, an aperture may be circular or generally diamond-shaped. The cut-outs may be, for example, shaped to correspond to a portion of a circle and can thus be semi-circular in some cases. Furthermore, the aperture may be substantially centered in the flat plate and the cut-outs can be substantially centered along a respective edge of the flat plate. In other cases, the aperture and/or cut-outs may not be centered in such a manner.

According to another embodiment of the present invention, a perforated flat plate is used to form a seismic damper for use in substantially eliminating non-linear displacement in an attached support structure. The flat plate has a regular geometric shape and includes a central aperture formed in and extending through the flat plate. At least one cut-out is also formed and centered along each side of the regular geometrically shaped flat plate, and each cut-out has a curved shape that is either a semi-circle or an arc. A tab is further formed at each corner of the flat plate and each tab intersects two adjacent tabs at a node, thereby forming an equal number of tabs and nodes. Each tab may further be adapted so that it can be connected to a member of a diagonal brace system. For instance, each tabs may connect to a member of the diagonal brace structure such that when the corresponding member of the diagonal brace structure undergoes tension or compression, the connected tab undergoes a corresponding tension or compression.

Such a seismic damper may also include a fuse area centered on each node. In some cases, the nodes also concentrate forces applied to the perforated flat plate at the fuse areas. The fuse areas may have any suitable shape and, in some cases, are substantially hourglass shaped. In the same, or other cases, the fuse area may also have a length of any suitable size, including a length which is less than that of an adjacent cut-out.

While the plate and aperture can have any suitable shape, in some cases both are regular geometric shapes. For example, both can have about the same geometric shape, as in a case in which the plate is square and the aperture is substantially square or diamond-shaped. In other cases, the flat plate and aperture have different regular geometric shapes, such as when the flat plate is square and the aperture is substantially circular.

In another embodiment, a seismically damped structural system is disclosed which includes multiple cross-members intersecting at a particular location. A single plate seismic damper can also be attached to each cross-member at the particular location. Such a single plate seismic damper can have any suitable configuration. For instance, the seismic damper can include a flat plate that has one or more apertures formed therein, and one or more cut-outs formed therein. The aperture may be formed inside the flat plate and extend through the thickness of the plate. The cut-outs may also extend through the thickness of the plate, but may be formed in an edge of each side of the flat plate. In this manner, the aperture and cut-outs can define a plurality of tabs at each corner of the flat plate, and a node between each adjacent tab. The nodes may also have a width which varies substantially across the length of the node and can be configured such that when a force is applied to the cross-members and transferred to the flat plate, the transferred force is substantially concentrated at the nodes.

In some cases, the particular location at which the seismic damper is attached is substantially centered on the plurality of cross-members. Additionally, the nodes may further include a fuse area such that when the force is transferred to the flat plate, the concentration of the force is substantially contained within the fuse area. The fuse area may be rectangular, square, hourglass shaped, or may have any other suitable shape or configuration. Irrespective of its shape, the fuse area can be adapted to non-elastically deform when sufficient force is applied. In such a case, the non-elastic deformation of the fuse area may absorb forces applied to the cross-members and substantially limits the cross-members to linear displacement.

Non-elastic deformation may occur, for example, when there are large seismic events. Further, the single plate damper may be replaceable and selectively removable so that it can be replaced after deformation occurring in one or more seismic events.

In another embodiment a seismic damper includes a substantially flat plate configured to be attached to a structure and absorb energy therefrom, and includes a substantially flat plate. The flat plate includes nodes that are each formed along a respective edge of the flat plate, and wherein each node is a narrowing portion between one or more internal perforations in the plate and an edge cut-out formed along a respective edge of the plate. The flat plate also defines multiple tabs that intersect with adjacent tabs at the nodes.

As a flat plate, the plate can include opposing faces (e.g., a top face and a bottom face, a left face and a right face, or arbitrary faces), while the perforations intersect the two faces and extend therebetween. A tension strap is also optionally mounted on at least one of the faces. The strap can be connected to at least two tabs of the flat plate, and the tabs can be opposing such that they are not adjacent. For example, where there are four tabs, the strap may attach to two tabs that are diagonal from each other. The tension strap may be arched so that when the plate deforms, the tension strap straightens. In some embodiments there are two tension straps. In such, one strap may be on each face, and the straps are optionally perpendicular to each other. For instance, with four tabs, one strap may connect to two diagonal tabs while the other strap connects to the other two diagonal tabs. In that event, if the plate is deformed, along one diagonal the plate may expand while along another diagonal the plate may contract. Thus, as one strap expands and straightens, the other strap may contract and/or become more arched.

While the plate may include a single perforation, it may also include multiple perforations. For instance, the perforations may include multiple holes, multiple slots, or a combination of one or more holes and one or more slots. Optionally, the flat plate is connected to another flat plate that is substantially identical. The flat plates can be connected, but rotated relative thereto, so that the apertures in the first plate do not necessarily align with apertures in the second plate, even if tabs and/or nodes align in the two plates. For instance, the plates may have apertures that are symmetric along exactly two axes of symmetry, so that when rotated relative to each other, the axes of symmetry for the two plates are also rotated relative to each other.

In accordance with another embodiment, a seismic damper can include a plate with two opposing surfaces that have perforations therebetween. Multiple nodes can also be included and formed along edges of the plate. The nodes may be formed in a narrowing region between the edge of the plate and the perforations. Tabs may also be included and adjacent tabs can intersect at the nodes. Two or more tension straps can also be mounted to the plate. In some cases, the opposing surfaces are flat and the perforations extend fully between the first and second surfaces. Additionally the perforations may be fully internal and not intersect any edge of the surface of the plate.

In some cases, the tension straps are parallel. For example, the two tension straps can be nested and both attached to the first surface, either directly or indirectly. With parallel straps, both can be mounted to the same tabs on the same surface of the plate. Additionally, the tension straps can be different lengths. Additionally, similar straps can be included on the opposing side of the plate such that both of the opposing sides have two straps. In some cases, the straps on the first surface may be parallel to each other, and the straps on the second surface may be parallel to each other, but the first and second tension straps may be perpendicular to the third and fourth tension straps. Optionally, the tension straps can also be arched when there is no tension present, and such that as the plate deforms under a tensile load, the tension straps straighten. The plate may also be made from multiple plates that are attached together.

In another aspect, a seismic damper includes a substantially flat perforated member that can attach to an intersection of two or more diagonal braces. The perforated member can define one or more perforations that extend at least partially though the perforated member and are centered around a center of the member. Cut-outs can be formed along the edges of the perforated member, and tabs can be included at each corner. The tabs may intersect with two adjacent tabs at nodes, and the tabs can be what connects to the diagonal braces. Two diagonal tension members may also be secured to the perforated member.

In some cases, there can be multiple perforations that define external and internal nodes. External nodes may be between the perforations and the edges of the flat plate, while internal nodes are between different perforations. Such a flat member may also exhibit delayed stiffening behavior during tensile loading. For example, during deformation, there may be an initial linear deformation region followed by a first yielding region. That first region may then be followed by a second linear deformation region and a second yielding region. The second linear deformation region may generally correspond to a loading at which a diagonal tension member is straightened during loading. Optionally, the perforations in the member are also symmetric about at least two axes of symmetry passing through the center of the perforated member.

In another aspect, a seismic damping system includes a seismic damper and tension straps attached to the seismic damper. The seismic damper can be configured to attach to cross-member supports of a structure and may include a plate. The plate can have first and second surfaces. The distance between the first and second surfaces can be the plate thickness and multiple perforations can extend the full thickness of the plate. Edge surfaces may also have cut-out regions that extend the full thickness of the plate. Tabs, internal nodes, and external nodes may also be defined by the perforations and cut-out regions. The internal and external nodes may be configured such that as load is transferred to the seismic damper, the load is concentrated at such nodes.

The seismic damper can have four straps attached thereto. For example, first and second straps may attach to a first surface of the plate and to non-adjacent tabs. Third and fourth straps may attach to a second surface of the plate and to non-adjacent tabs. The non-adjacent tabs of the first and second straps may be the same, but may be different than the tabs of the third and fourth straps. The first and third tension straps may also be longer than the second and fourth tension straps. The second strap may be nested within the first tension strap and the fourth tension strap may be nested within the third tension strap.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope, nor are the drawings necessarily drawn to scale. The invention will be described and explained with additional specificity and detail through the use of the accompanying drawings in which.

DETAILED DESCRIPTION OF EXAMPLE EMBODIMENTS

Figure 1A:
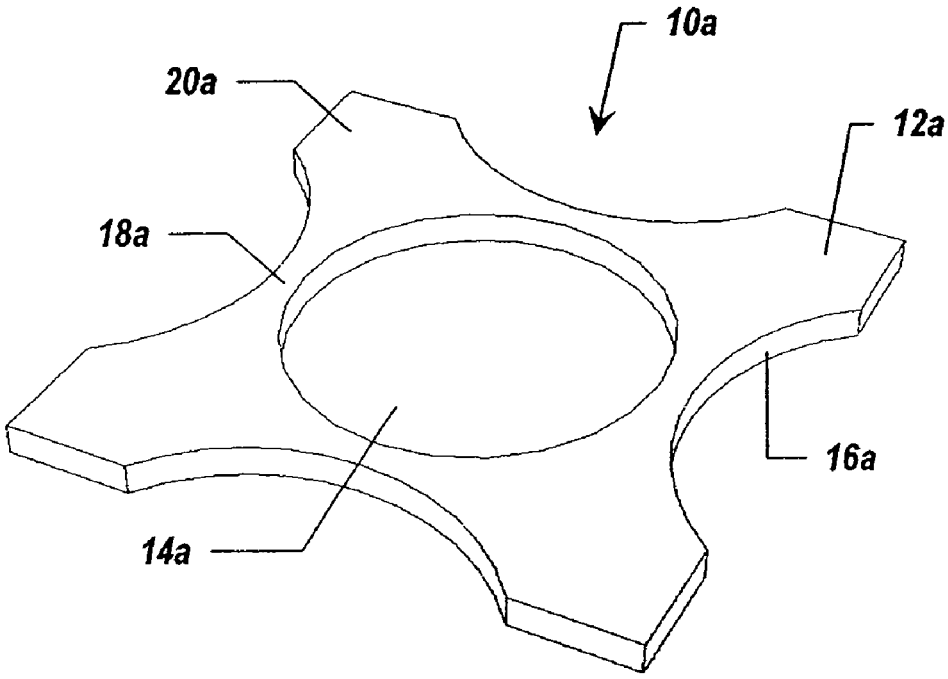
FIG. 1A illustrates a perspective view of a perforated plate seismic damper according to one embodiment of the present invention, the damper having perforations to focus shear and tension forces occurring during a seismic event on nodes within the damper.

Exemplary embodiments of the invention relate to a seismic damper which, when fixed to a structure, can absorb significant amounts of energy through deformation, thereby reducing the overall displacement and damage to a structure. A seismic damper of the system can include a single plate which includes fuse areas configured to deform as a structure experiences seismic accelerations, and which can accumulate such deformation through multiple cycles. In embodiments in which a single plate damper is used, the damper can be simply and efficiently fabricated at low cost, thereby also allowing the damper to be cost efficiently replaced after excessive deformation.

Reference will now be made to the drawings to describe various aspects of exemplary embodiments of the invention. It is understood that the drawings are diagrammatic and schematic representations of such exemplary embodiments, and are not limiting of the present invention. Accordingly, while the drawings illustrate an example scale of certain embodiments of the present invention, the drawings are not necessarily drawn to scale for all embodiments. No inference should therefore be drawn from the drawings as to the required dimensions of any invention or element, unless such dimension is recited in the appended claims. In the following description, numerous specific details are set forth in order to provide a thorough understanding of the present invention. It will be obvious, however, to one of ordinary skill in the art that the present invention may be practiced without these specific details.

FIGS. 1A-1D illustrate various views of an exemplary embodiment of a seismic damper 10*a* according to one embodiment of the present invention. In particular, FIGS. 1A-1D illustrate an exemplary seismic damper 10*a* which can absorb energy generated during a seismic event, and which may do so by stretching in a non-linear manner when a load reaches a threshold level, thereby limiting displacement of an associated support or bracing structure to non-linear displacement. In this manner, seismic accelerations may deform seismic damper 10*a*, such that non-linear deformation is substantially confined to seismic damper 10*a*, thereby reducing lateral displacement of an attached structure and possibly limiting inter-story drift.

As illustrated in FIGS. 1A-1D, seismic damper 10*a* can include, according to one exemplary embodiment, a plate 12*a* which can be configured to receive the seismic loading and deform in a non-linear manner. In the illustrated embodiment, plate 12*a* is generally square in shape, and has a thickness which is substantially less than the length of the sides of the square, although it will be appreciated that these dimensions are exemplary only and not limiting of the present invention. In fact, in other embodiments, plate 12*a* can have a variety of other shapes, including circular, rectangular, oval, triangular, hexagonal, or any other regular or irregular geometric shape.

In some embodiments, plate 12*a* can be configured to focus forces, such as tensile, compressive and/or shear forces, which can act on seismic damper 10*a*. For example, plate 12*a* may be constructed so as to concentrate any such forces primarily within specific, predetermined portions of plate 12*a*. Any suitable manner of focusing the forces to the specific, predetermined portions of plate 12*a* may be implemented. For example, and as illustrated in FIGS. 1A-1D, portions of plate 12*a* can be removed, such that a lesser area is provided within plate 12*a* for being acted upon by the associated forces. For instance, in the illustrated embodiment, an aperture 14*a* may be formed in seismic damper 10*a*. By having aperture 14*a* formed in seismic damper 10*a*, material is removed from plate 12*a* such that as a force is applied to seismic damper 10*a*, the forces are distributed over principally, or only, the un-removed portion of plate 12*a*. As discussed in more detail herein, as forces may be distributed unevenly over plate 12*a*, such forces may further be focused principally to interfaces between portions of plate 12*a* which are situated between the unevenly distributed forces.

Figure 1B:
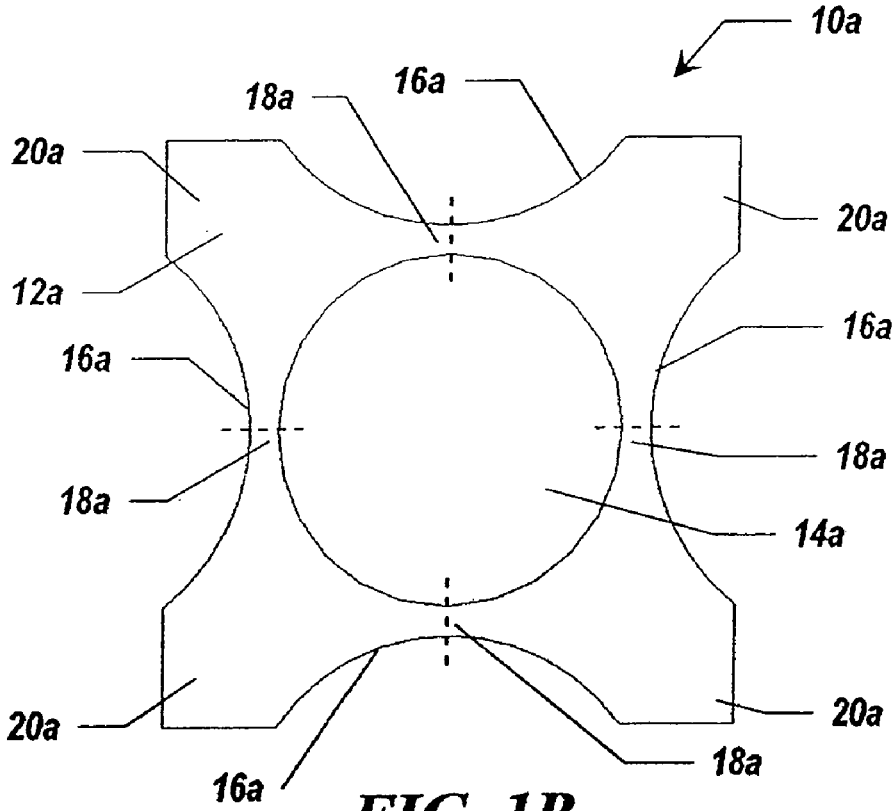
FIG. 1B illustrates a top view of the perforated plate seismic damper of FIG. 1A.
Figure 1C:
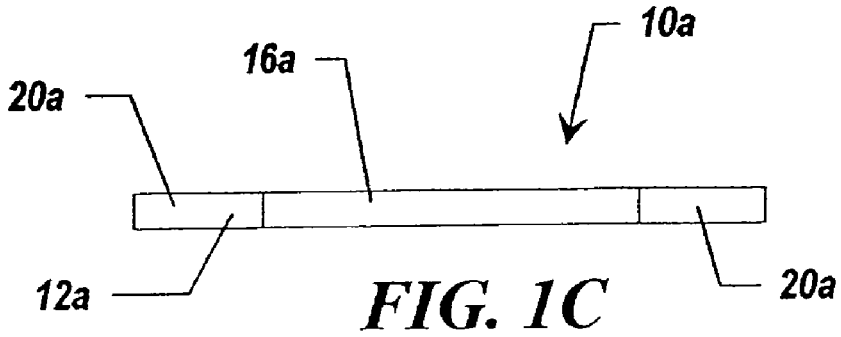
FIG. 1C illustrates a side view of the perforated plate seismic damper of FIGS. 1A and 1B.

As best illustrated in FIG. 1B, according to one embodiment of the invention, aperture 14*a* can have a substantially circular shape and may be substantially centered on plate 12*a*, although this arrangement is exemplary only. In other embodiments, for example, aperture 14*a* has other shapes (e.g., diamond, square, rectangle, octagonal, etc.) or placements (e.g., off-center). Moreover, in still other embodiments, more than one aperture may be formed in plate 12*a* and arranged such that the multiple apertures are centered or off-center relative to plate 12*a*.

Aperture 14*a* can be formed in plate 12*a* in any suitable manner, and no particular method for forming aperture 14*a* is to be considered limiting of the present invention. For example, plate 12*a* may be formed of a metal such as iron or steel. In such an exemplary embodiment, aperture 14*a* may be formed by machining plate 12*a* (e.g., drilling, milling, reaming, punching, cutting, slotting, broaching, grinding, etc.) or otherwise carving out aperture 14*a* in plate 12*a*. In other embodiments, however, aperture 14*a* may be formed substantially simultaneously with plate 12*a* such as by, for example, forming plate 12*a* with aperture 14*a* during a casting (e.g., die casting, sand casting, investment casting, etc.) or molding process.

To further allow seismic energy to be focused within seismic damper 10*a*, seismic damper 10*a* can include, in some example embodiments, one or more additional cut-outs that remove additional material from plate 12*a*. For example, in the illustrated embodiment of FIGS. 1A-1D, seismic damper 10*a* can include four cut-outs 16*a* which are each formed or machined along an outside edge of plate 12*a*. Cut-outs 16*a* can also be formed in any suitable manner, including any manner discussed herein for forming aperture 14*a*.

Cut-outs 16*a* may be adapted to have any of a variety of different shapes and configurations. In the illustrated embodiment, for example, cut-outs 16*a* have a substantially constant curvature, thereby forming an arc along each of the four sides of plate 12*a*. In other embodiments, however, exemplary cut-outs may have only straight edges and sharp corners, or may have other configurations. For example, exemplary cut-outs may take the form of any portion of a circle, triangle, square, rectangle, trapezoid, rhombus, hexagon, or virtually any other simple, complex, regular, irregular, symmetrical, or non-symmetrical geometric shape. Cut-outs 16*a* may also, by way of example and not limitation, be centered along the sides of plate 12*a*, although this feature is not necessary. For example, in alternative embodiments, a cut-out may be formed at a corner of a plate forming a seismic damper and/or multiple cut-outs may be formed on one or more side of such a plate.

Cut-outs 16*a* may also have any of a variety of sizes. For example, while the embodiment illustrated in FIGS. 1A-1D illustrates that the length of cut-outs 16*a* along the may be about equal to the diameter of circular aperture 14*a*, it will be appreciated in light of the disclosure herein that this feature is exemplary only. In particular, in other embodiments, cut-outs 16*a* may have lengths larger or smaller than the diameter, major axis, minor axis or length of one or more apertures within plate 12*a*. In other embodiments, a cut-out or aperture may be excluded. For example, in one embodiment, cut-outs are formed which extend substantially towards a middle of the flat plate, such that no aperture is also formed in the plate.

Figure 1D:
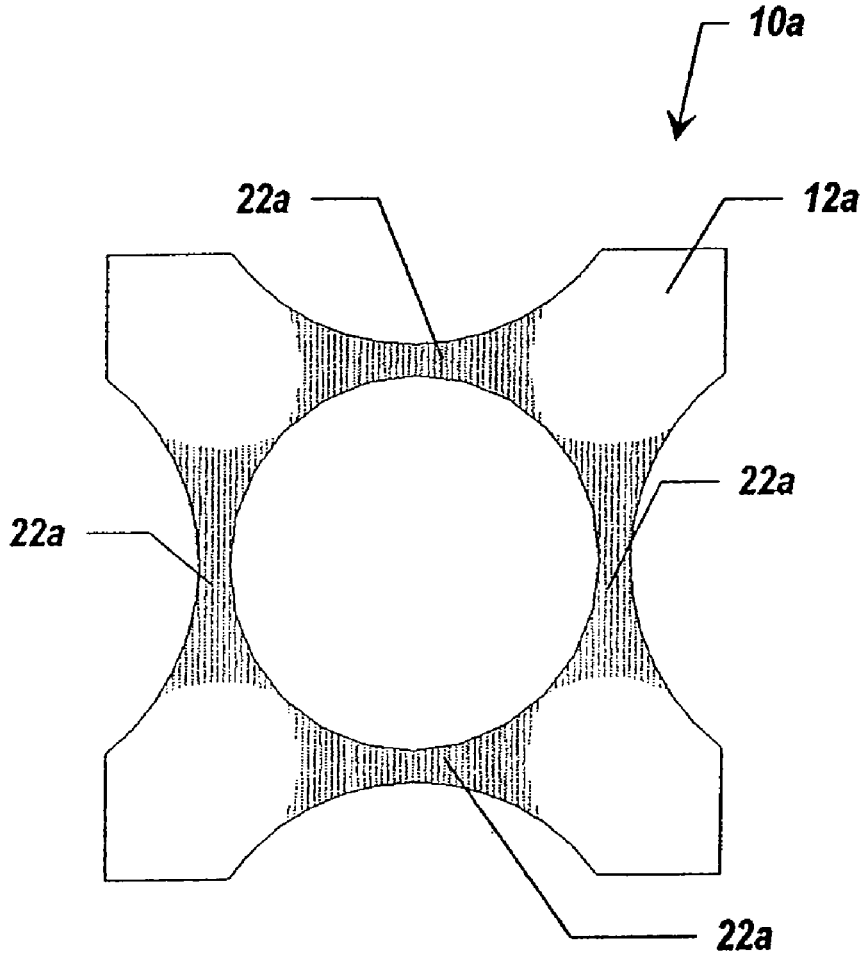
FIG. 1D illustrates a top view of the perforated plate seismic damper of FIG. 1A, further illustrating the nodes on which shear and tension forces are focused.

As noted above, the four cut-outs 16*a* are, in the illustrated embodiment, each substantially centered along a respective side of square plate 12*a*, thereby forming four tabs 20*a*, which are, in the illustrated embodiment, separated by the dashed lines. In this manner, each of tabs 20*a* may be aligned with, and include, a corner of plate 12*a*. Additionally, as best illustrated in FIGS. 1B and 1D, cut-outs 16*a* can form continuous arches on the sides of plate 12*a*, thereby causing plate 12*a* to neck down towards aperture 14*a*. For example, plate 12*a* can neck down to form four nodes 18*a* which are centered on the intersection between tabs 20*a*, at the point where plate 12*a* necks down.

Nodes 18*a* can be fuse points situated between, and connecting each of tabs 20*a*. Furthermore, in some cases, such as where plate 12*a* necks down at or near nodes 18*a*, nodes 18*a* can focus seismic energy which acts on seismic damper 10*a* and/or an associated support or bracing structure attached to seismic damper 10*a*.

Figure 2:
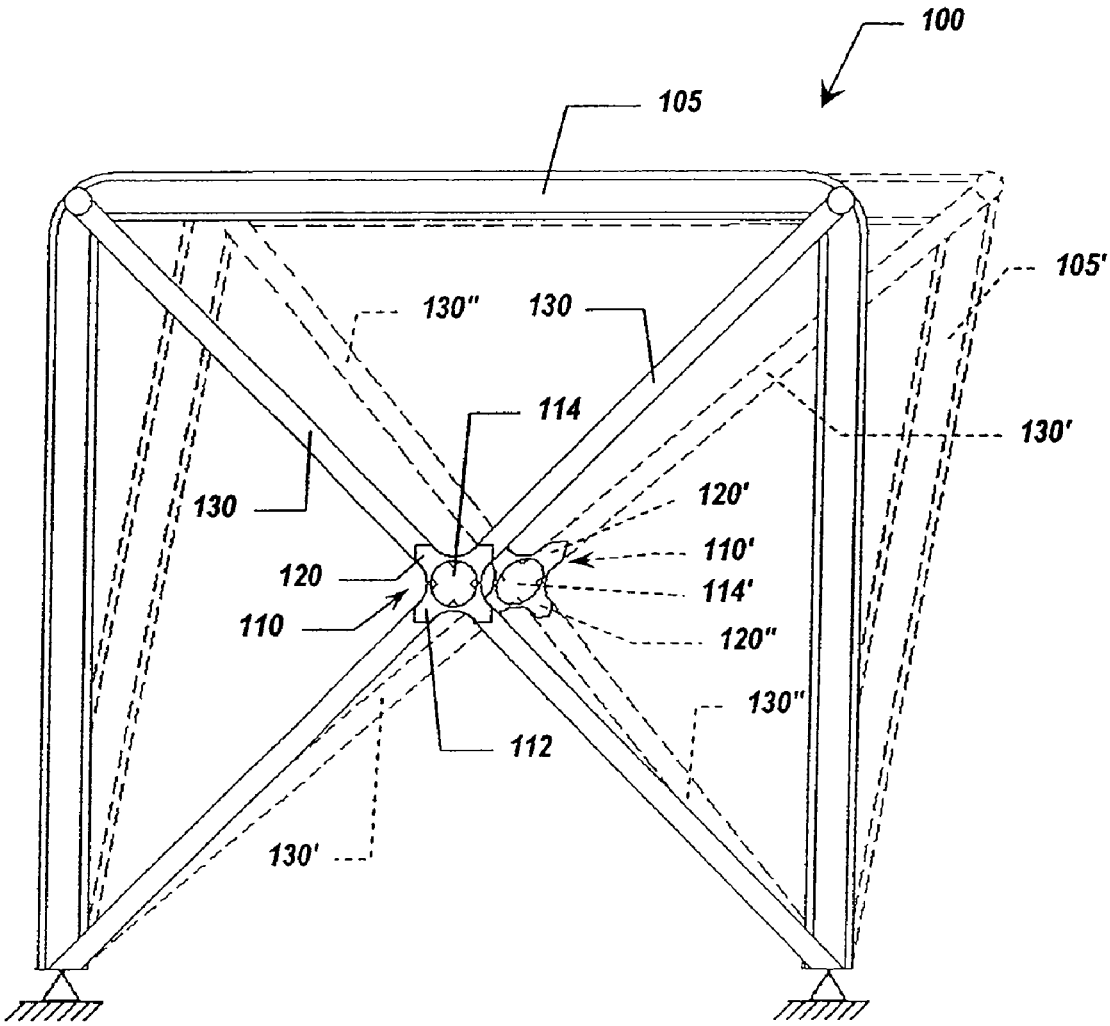
FIG. 2 illustrates a brace and support system having cross members on which a perforated plate seismic damper is implemented.

For example, with reference now to FIG. 2 a plurality of tabs 120 can be configured to be attached to one or more bracing members 130 of a brace system 105 within a seismic damping brace system. In the embodiment illustrated in FIG. 2, for instance, bracing members 130 are diagonal, cross-members which are each angularly offset from each other at about equal ninety degree intervals. In the illustrated embodiment, each cross-member can also be aligned with, and/or connected to, one of tabs 120 of seismic damper 110, thereby installing seismic damper 110 in about the center of the cross-members of the bracing system.

As a seismic or other event causes the support system to move laterally, brace system 105 can move laterally to a position such as that illustrated in FIG. 2 as brace system 105'. As will be appreciated, in the illustrated embodiment, brace system 105 may be an equilibrium position while brace system 105' may be a position which requires some external forces.

As brace system 105 moves laterally to the position of brace system 105', cross-members 130 can be placed in tension and/or compression. For instance, in brace system 105', the bracing cross-members 130' can be stretched and placed in tension as brace system 105' moves laterally in one direction, thereby elongating brace members 130'. In contrast, bracing cross-members 130" can be placed under compression, thereby reducing the length of brace members 130' from their equilibrium length in brace system 105. It will also be appreciated in view of the disclosure herein that a force which causes brace system 105 to move to position 105' may also oscillate. In such a manner, brace system 105 may move laterally in each direction (illustrated as left and right in FIG. 2). Thus, cross-members 130 may alternatively move from tension to compression.

As brace members 130 undergo tension and/or compression, seismic damper 110 can also be stressed in a tensile and/or compressive manner. For example, in the illustrated embodiment, a tab 120' of seismic damper 110' which is connected to a support member 130' under tension may also be subjected to tensile forces. In a similar manner, if a tab 120" of seismic damper 110' is connected to a support member 130" under compression, the corresponding tabs 120" may also be placed under compression.

As each tab 120 can be placed in compression or tension, as dictated by the associated support member to which it is attached, at a particular instant of time, one or more of tabs 120 (e.g., tabs 120') can be in tension while one or more other of tabs 120 (e.g., tabs 120") can be in compression. As a result, seismic damper 110 can be placed under both compressive and tensile stresses at any particular instant. Further, as noted above, as brace system 105 to which seismic damper 10*a* is attached oscillates, these compressive and tensile stresses can switch directions and magnitudes. Thus, while braces 130' and tabs 120', and braces 130" and tabs 120', are illustrated as being under tension and compression, respectively, when brace system 105 sways in the opposite direction, the tensile and compressive nature of such stresses can be reversed.

A seismic event may induce displacement within a structure such as seismic damping brace system 100. In small seismic events, the displacement may be largely linear, whereas a large seismic event can induce non-linear displacement within a structure and/or within seismic damping brace system 100. Such non-linear displacement can cause significant damage, however, if passed on to brace system 105. Accordingly, to reduce, and possibly eliminate, the non-linear movement of brace system 105, tensile and compressive stresses, and their associated shear stresses, may be concentrated in seismic plate 112, rather than in brace system 105, including cross-members 130. In particular, and as described herein, a seismic damper such as seismic damper 110, may include a plurality of nodes which have a reduced and possibly necked area which acts as fuse points between a plurality of tabs. As the shear, compressive, and/or tensile forces act on the plate, these forces can then be focused at the nodes, which may substantially confine non-linear strains therein, thereby allowing an attached structure, such as brace system 105 to move linearly. Thus, nodes within plate 112 can absorb significant amounts of energy to reduce the lateral displacement of brace system 105.

Moreover, as the seismic forces or other forces cause brace system 105 to move back-and-forth, diagonal cross-members 130 may experience a pattern of extension along one diagonal and contraction along the other. A similar pattern is transferred to seismic damper 110 where tabs 120 experience patterns of expansion and contraction. When seismic damper 110 is loaded beyond its elastic capacity, seismic damper 110 begins to deform in a non-elastic manner, thereby absorbing energy. This energy and deformation can also be focused on nodes within plate 112 which have, in one example, a reduced area.

In particular, as tensile and shear forces act on nodes such as nodes 18*a* in FIG. 1B, the area of the nodes can deform. Further, as brace system 105 moves in the opposite direction, shear forces acting on nodes 118 can reverse direction to further deform the material. Moreover, as the shear forces reverse direction, the shear forces can act in opposite planes, thereby allowing for multiple cycles of loading.

Returning briefly to FIGS. 1B and 1D, an exemplary seismic damper 10*a* is illustrated in which nodes 18*a* are illustrated. In the illustrated embodiment, each of nodes 18*a* (shown in FIG. 1B) has an associated fuse area 22*a* representative of the portion of plate 12*a* which represents the portions of plate 12*a* which can undergo the bulk of non-linear displacement and non-elastic deformation which plate 12*a* experiences during a major seismic event. Thus, forces acting on seismic damper 10*a* can be substantially focused within fuse areas 22*a*, such that fuse areas 22*a* can absorb significant amounts of energy that would otherwise extend to an attached brace system, thereby allowing the attached brace system to instead undergo largely or wholly linear displacement, and thereby reducing, and possibly eliminating, damage associated with non-linear displacement.

In light of the disclosure herein, it will be appreciated that seismic damper 10*a* can, accordingly, accumulate deformation to allow the damper to perform through multiple cycles. Multiple cycles may occur, for example, in a single, major seismic event and/or in multiple major or minor seismic events. Following such an event or series of events, seismic damper 10*a* can be replaced.

Moreover, because seismic damper 10*a* can, in some example embodiments, comprise a single flat plate 12*a* having one or more apertures 14*a* and/or cut-outs 16*a* formed therein, seismic damper 10*a* can be easily fabricated and installed. For instance, flat plate 12*a* can be formed of a suitable metal, alloy, polymer, ceramic, composite, or other material. For example, flat plate 12*a* may be formed of a solid or hollow plate of steel. Such a plate can thus be manufactured at low cost, thereby allowing seismic damper 10*a* to be installed on any class of braced building to provide high-performance structural damping. Moreover, as tabs 20*a* can be connected to support braces, seismic damper 10*a* can be installed on new construction, and/or can be used to retrofit and rehabilitate existing construction, or can replace an existing seismic damper which has experienced excessive nodal deformations.

Although FIGS. 1A-1D and FIG. 2 illustrate similar seismic dampers having that have a generally square configuration with a circular, central aperture and various arched cut-outs on the sides of the square plate, it will be appreciated that these features, collectively and individually, are merely representative of the present invention and not limiting thereof. Indeed, various other configurations are suitable and contemplated.

For example, in other embodiments, a brace system may have braces which are not equally offset at ninety degree angles as is illustrated in FIG. 2, such that a seismic damper (e.g., seismic damper 10*c* of FIG. 4) having a rectangular, rather than square, configuration would be desirable. In still other embodiments, a seismic damper may be attached to three brace members, such that a triangular seismic damper (e.g., seismic damper 10*d* of FIG. 5) can be used. Moreover, in some embodiments, a single central aperture may be eliminated and/or replaced by a plurality of apertures which are offset in a regular or irregular pattern. Similarly, one or more cut-outs may be formed on the sides or corners of a plate in a regular pattern, or one or more sides have a different pattern of cut-outs.

Accordingly, it will be appreciated that the dimensions and configuration of a seismic damper according to aspects of the present invention can be varied as necessary for any particular structural brace system, and for energy absorption to be provided according to a variety of different considerations. For instance, in some embodiments, seismic damper 10*a* may be about twenty inches by twenty inches. Moreover, in additional exemplary embodiments, central aperture 14*a* may be about twelve inches in diameter, cut-outs 16*a* have lengths of about twelve inches, and/or cut-outs 16*a* having a depth of about three inches. Moreover, plate 12*a* can have a thickness between one-half and five inches. It will be appreciated, however, that these dimensions are exemplary only and that in other embodiments, plate 12*a*, aperture 14*a* and cut-outs 16*a* may have other dimensions, sizes, shapes, or configurations.

Now turning to FIGS. 3A-3D, an exemplary embodiment of a seismic damper 10*b* is illustrated according to an alternative embodiment of the present invention, and can be configured to absorb energy so as to confine a corresponding brace system to displacement in substantially only a linear manner.

In particular, FIGS. 3A-3D illustrate an exemplary seismic damper 10*b* which can absorb energy generated during a seismic event by stretching in a non-linear manner when a load reaches a threshold level, thereby largely limiting displacement of an associated support or bracing structure to linear displacement. In this manner, seismic accelerations deform seismic damper 10*b*, such that non-linear deformation is substantially confined to seismic damper 10*b*, thereby reducing or eliminating non-linear displacement, reducing lateral displacement of the structure, and limiting inter-story drift.

As illustrated in FIGS. 3A-3D, a seismic damper 10*b* can include, according to one exemplary embodiment, a plate 12*b* which can be configured to receive the seismic loading and deform in a non-linear manner. In the illustrated embodiment, for example, plate 12*b* is generally square in shape, and has a thickness which is substantially less than the length of the sides of the square, although it will be appreciated that these dimensions are exemplary only and not limiting of the present invention. In fact, in other embodiments, plate 12*b* can have a variety of other shapes, including circular, oval, triangular, rectangle, hexagonal, octagonal, or any other regular or irregular geometric shape.

In some embodiments, plate 12*b* can be configured to focus forces (e.g., tensile, compressive, and/or shear forces) which may act on seismic damper 10*b* so as to substantially concentrate the forces within specific, predetermined portions of plate 12*b*. To focus any such forces, portions of plate 12*b* can be removed, such that a lesser area is provided within plate 12*b* for being acted upon by the associated forces. For example, in the illustrated embodiment, seismic damper 10*b* includes an aperture 14*b* which is formed in plate 12*b* of seismic damper 10*b*. By having aperture 14*b* formed in seismic damper 10*b*, material is removed from plate 12*b* such that as a force is applied to seismic damper 10*b*, the forces are distributed over the un-removed portion of plate 12*b* which has not been removed. In other words, by removing the material to form aperture 14*b*, a force applied to seismic damper 10*b* is distributed over a smaller area.

Moreover, adjacent aperture 14*b* plate 12*b* may include a plurality of nodes 18*b* at which forces are focused. As discussed herein, nodes 18*b* can act as fuse points between various tabs 20*b* which can be placed under different forces. As different forces act on tabs 20*b*, forces can further be focused at nodes 18*b*.

In the embodiment illustrated in FIGS. 3A-3D, aperture 14*b* is of a substantially diamond-shaped configuration, with rounded corners, and is substantially centered on plate 12*b* with the rounded corners of aperture 14*b* being centered along the four sides of plate 12*b*. It will be appreciated, however, that this arrangement is exemplary only. In other embodiments, for example, aperture 14*b* has other shapes (e.g., circular, square, rectangle, octagonal, sharp corners, etc.) or configurations (e.g., off-center, corners aligned with corners of plate 12*b*, etc.). Moreover, in still other embodiments, more than one aperture may be formed in plate 12*b*.

To further allow seismic energy to be focused within seismic damper 10*b*, seismic damper 10*b* can include, in some example embodiments, one or more additional cut-outs which remove additional material from plate 12*b*. For example, in the illustrated embodiment of FIGS. 3A-3D, seismic damper 10*b* can include four cut-outs 16*b*, one cut-out 16*b* being formed or machined on each outside edge of plate 12*b*. Cut-outs 16*b* can also have any of a variety of shapes and configurations. In the illustrated embodiment, for example, cut-outs 16*b* are about semi-circular in shape, thereby forming an arc along each of the four sides of plate 12*b*. Cut-outs 16*b* may also, by way of example and not limitation, be centered along the sides of plate 12*b*, although this feature is not necessary. Further, in alternative embodiments, multiple cut-outs may be formed on each side of plate 12*b* and/or be aligned in the corners of plate 12*b*.

Cut-outs 16*b* may also have any of a variety of different sizes. For example, semi-circular cut-outs 16*b* can have a length along the side of plate 12*b* which is about half the distance across aperture 14*b* (i.e., from point-to-point in aperture 14*b*). It will be appreciated in light of the disclosure herein, however, that such an arrangement is exemplary only. For example, in other embodiments, cut-outs 16*b* may have lengths and/or diameters which are more or less than half the distance across aperture 14*b*, or which is about the same size as, or larger than, the distance across aperture 14*b* within plate 12*b*.

In the illustrated embodiment, cut-outs 16*b* are each substantially centered along a respective side of square plate 12*b*, thereby forming four tabs 20*b*, which are, in the illustrated embodiment, separated by the dashed lines. In this manner, each of tabs 20*b* can be aligned with, and include, a corner of plate 12*b*. Additionally, cut-outs 16*b* can form continuous arches on the sides of plate 12*b*, which cause plate 12*b* to neck down towards aperture 14*b*. For example, as illustrated in FIGS. 3B and 3D, plate 12*b* can neck down to form four nodes 18*b* which are centered on the intersection between tabs 20*b*, and at about the point where plate 12*b* necks down to the smallest distance between cut-outs 16*b* and aperture 14*b*.

As described previously with respect to tabs 120 in FIG. 2, tabs 20*b* can, in some embodiments, be configured to attach to one or more braces in a corresponding brace system. Such an attachment may be made by mechanical fasteners (e.g., screws, rivets, nails, clamps, staples, etc.) which are integral with, or separable from, tabs 20*b*, by welding or adhesives, or by the use of any other suitable attachment means. In this manner, as the structure to which seismic damper 10*b* is attached undergoes seismic accelerations and moves laterally, seismic damper 10*b* can absorb substantial amounts of energy within nodes 18*b*, thereby possibly confining non-linear displacement to plate 12*b* and allowing the attached brace system to experience only linear displacement.

Figure 3A:
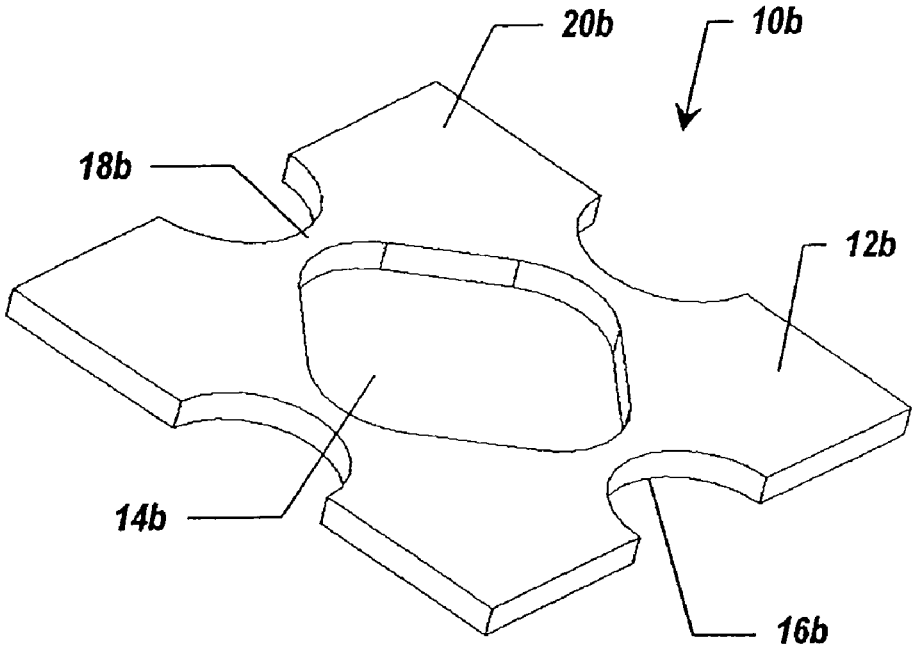
FIG. 3A illustrates a perforated plate seismic damper according to an alternative embodiment of the present invention, the damper having an alternative configuration of perforations for focusing forces on nodes within the damper.
Figure 3B:
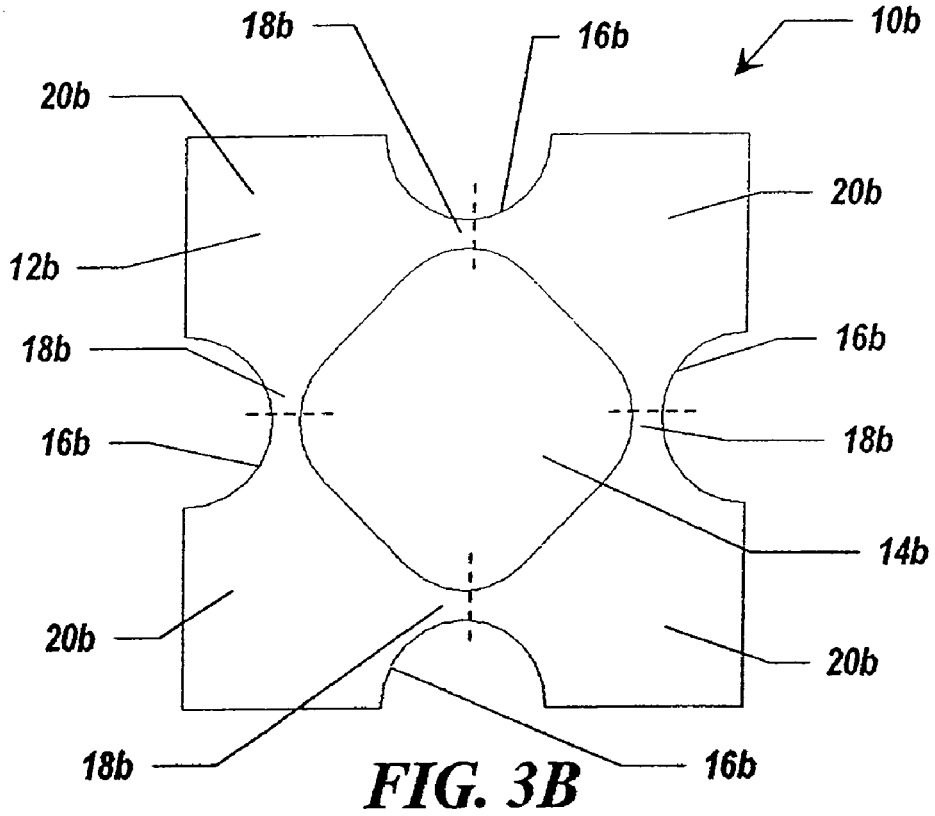
FIG. 3B illustrates a top view of the perforated plate seismic damper of FIG. 3A.
Figure 3C:
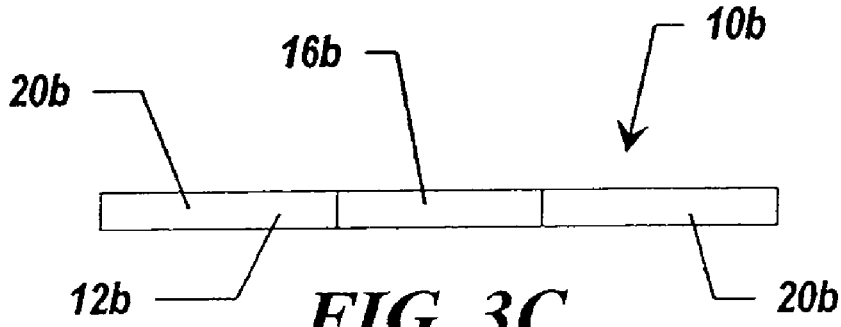
FIG. 3C illustrates a side view of the perforated plate seismic damper of FIGS. 3A and 3B.
Figure 3D:
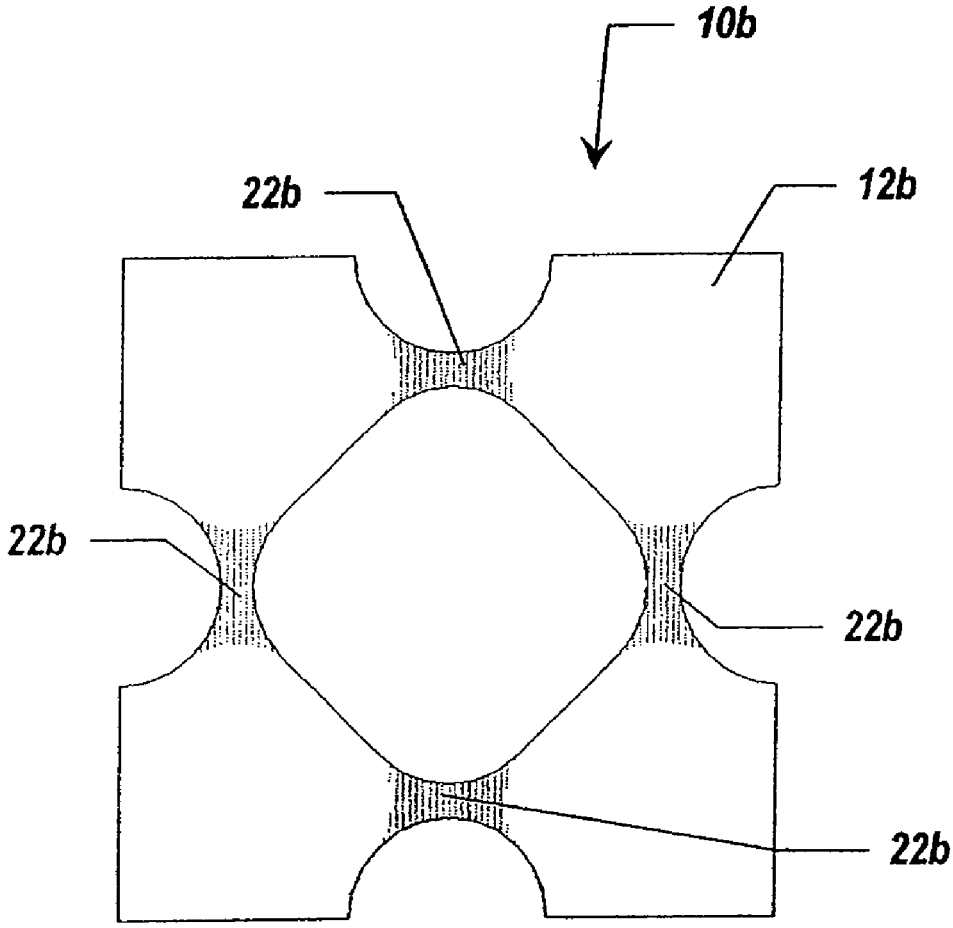
FIG. 3D illustrates a top view of the perforated plate seismic damper of FIG. 3A, further illustrating the nodes on which shear and tension forces are focused.

As illustrated in FIG. 3D, nodes 18*b* (shown in FIG. 3B) can have associated fuse areas 22*b* in which stresses caused by the seismic acceleration are concentrated. Such fuse areas 22*b* can undergo non-elastic deformation during a seismic event, thereby absorbing significant amounts of energy such that an attached brace system may be displaced in only a linear manner, thereby reducing, and possibly eliminating, damage associated with non-linear displacement.

In the embodiment illustrated in FIGS. 3B and 3D, it can be seen that fuse areas 22*b* may have a generally hour-glass shape that is centered on a corner of diamond-shaped aperture 14*b*, and may be sized such that the length of fuse areas 22*b* is less than a length of cut-outs 16*b*. It should be appreciated that this is exemplary only. For example, in FIGS. 1B and 1D, a fuse area 22*a* may also have a generally hour-glass shape and have a length less than a length of cut-out 16*a*, but may not be centered on corners of a diamond. In other embodiments, the shape of the fuse area in which stresses and/or strains are concentrated may take other shapes, and such shapes may be dependent on the dimensions and shapes of the features of an associated seismic damper and/or the material used to form the seismic damper.

Figure 4:
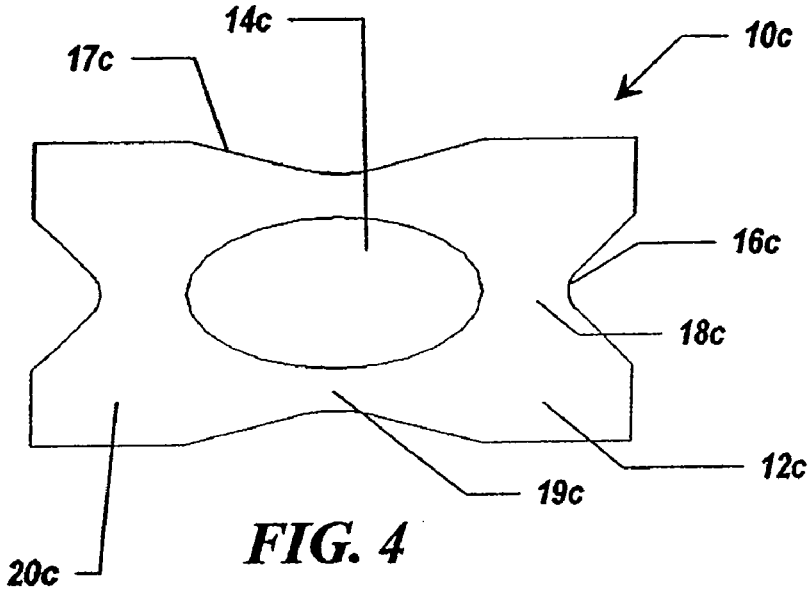
FIGS. 4-9 illustrate other example configurations of perforated plate seismic dampers according to other aspects of the present invention.
Figure 5:
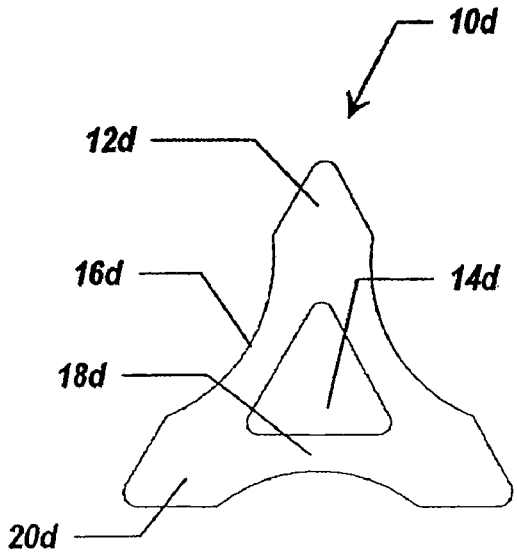
Figure 6:
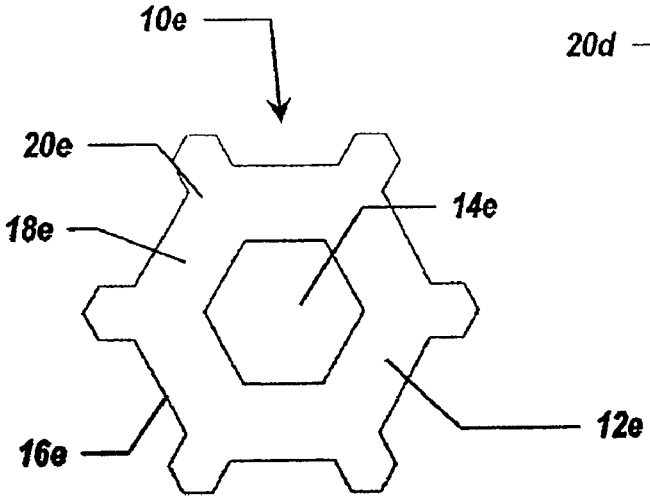

For example, FIGS. 4-6 illustrate various other example embodiments of exemplary seismic dampers which may be used to attach to various alternative brace structures and/or have fuse areas of different sizes, shapes, locations and/or configurations. In FIG. 4, for example, a seismic damper 10*c* is made from a substantially flat plate 12*c* that has a generally rectangular configuration. Such a shape may be desirable where, for example, seismic damper 10*c* is to be attached to four cross-braces of a support structure which are not equally offset at ninety-degrees. For example, seismic damper 10*c* may be attached to cross-members that are alternatively offset at one hundred-twenty degrees and sixty degrees, although any other unequal offset may also be accounted for.

In the illustrated embodiment, flat plate 12*c* may include one or more apertures 14*c* and/or cut-outs 16*c*, 17*c*. In the illustrated embodiment, for instance, an oval aperture 14*c* is formed in flat plate 12*c* and substantially centered therein. As disclosed herein, aperture 14*c* can also include any other shape, such as a circle or rectangle, and/or may optionally be off-center relative to rectangular plate 12*c*. Furthermore, as illustrated in FIG. 4, it is not necessary that cut-outs 16*c*, 17*c* each have the same shape and/or configuration. For instance, in the illustrated embodiment, cut-outs 16*c* are formed along the shorter edges of rectangular plate 12*c*, and are generally shaped as an acute triangle. In contrast, cut-outs 17*c* are formed along the longer edges of rectangular plate 12*c* and are generally shaped as an obtuse triangle.

By varying the size and/or shape of cut-outs 16*c*, 17*c*, it will also be appreciated that the size and/or shape of nodes 18*c*, 19*c*, as well as the fuse areas associated therewith, can also be different. For example, nodes 18*c* may have more distance between cut-outs 16*c* and aperture 14*c*, while nodes 19*c* may have a relatively shorter distance between cut-outs 17*c* and aperture 14*c*. However, the length of nodes 19*c* may also be corresponding larger than the length of nodes 18*c*, although this is exemplary only. In other embodiments, the distance between cut-outs 16*c*, 17*c* and aperture 14*c* may be about the same.

As further illustrated, seismic damper 10*c* can also include a tab 20*c* in each corner of rectangular plate 12*c*. The tab 20*c* can be defined by the cut-outs 16*c*, 17*c* and aperture 14*c*, and the tabs 20*c* can intersect at a line centered in nodes 18*c*, 19*c*. Further, in the illustrated embodiment, it can be seen that while each tab 20*c* may optionally have about the same shape or mirrored shape of the other tabs 20*c*, it is not necessary that tabs 20*c* be symmetrical. For instance, the length of tab 20*c* to cut-outs 16*c*, 17*c* may vary, thereby forming asymmetrical tabs 20*c*.

Now turning to FIG. 5, another example embodiment of a seismic damper 10*d* is illustrated. In the illustrated embodiment, seismic damper 10*d* is formed of a substantially flat plate 12*d* and can have a generally triangular shape. Specifically, in the illustrated embodiment, seismic damper 10*d* has triangular shape with rounded corners and rounded cut-outs 16*d* along each edge of flat plate 12*d*, although in other embodiments, the corners of flat plate 12*d* need not be rounded and/or cut-outs 16*d* may be omitted, have flat edges, or be otherwise shaped.

As also illustrated, in the example embodiment, flat plate 12*d* also can have an optional aperture 14*d* formed therein. In this embodiment, aperture 14*d* also has a generally triangular configuration and is aligned with the triangular configuration of flat plate 12*d*, although this is also exemplary and can be varied in any manner described herein. Three tabs 20*d* can also thusly be formed at or near each corner of flat plate 12*c* and can join at or near nodes 18*d*. As with the nodes in the other seismic dampers herein, nodes 18*d* may be locations within flat plate 12*d* at which stresses are concentrated to deform flat plate 12*d*. As flat plate 12*d* may be attached to a structural member which is subjected to seismic of other events, the concentration of stresses in nodes 18*d* can thus largely confine non-linear displacement and non-elastic deformation to flat plate 12*d*, and allow the attached structural member to undergo substantially only linear displacement.

Seismic damper 10*d* can be useful for a number of different applications. One application, for instance, is in connection with a structural member which has three joining cross-members. In such a system, each tab 20*d* can be connected to a respective cross-member and absorb the tensile, compressive, and/or shear forces applied thereto.

In view of the disclosure herein, it should be appreciated that a seismic damper can be constructed according to the present invention to attach to structural members and diagonal cross-members of virtually any size, shape, or configuration. For instance, FIG. 6 illustrates another example embodiment of a seismic damper 10*e* constructed for application in a structural support having six joining cross-members. In the illustrated embodiment, seismic damper 10*e* is formed from a flat plate having a substantially hexagonal shape.

Flat plate 10*e* can thus also include one or more optional apertures 14*e* of any suitable shape. For instance, aperture can be substantially circular, triangular, square, or elliptical, or may be substantially hexagonal as illustrated. Furthermore, although the illustrated embodiment illustrates substantially straight edges on flat plate 12*e* and aperture 14*e*, it will be appreciated that either or both of flat plate 12*e* and aperture 14*e* may have rounded or curved edges as may be desirable to, for example, reduce stress concentrations at discrete locations.

As further illustrated, seismic damper 10*e* can also include a plurality of cut-outs 16*e* centered along one or all of the edges of flat plate 12*e*. In this embodiment, cut-outs 16*e* form a portion of a trapezoid, and further define, in connection with aperture 14*e*, six tabs 20*e* and six nodes 18*e*, which are centered at the intersection of tabs 20*e*, thereby providing a generally wagon-wheel shape to seismic damper 10*e*. In the illustrated embodiment, and in contrast to some other embodiments disclosed herein, it can be seen that nodes 18*e* can have a generally constant width across a substantial length of node 18*e*, although this is exemplary only. In other embodiments, such as those others disclosed herein, a node can neck down and have a width that varies across substantially its entire length.

Figure 7A:
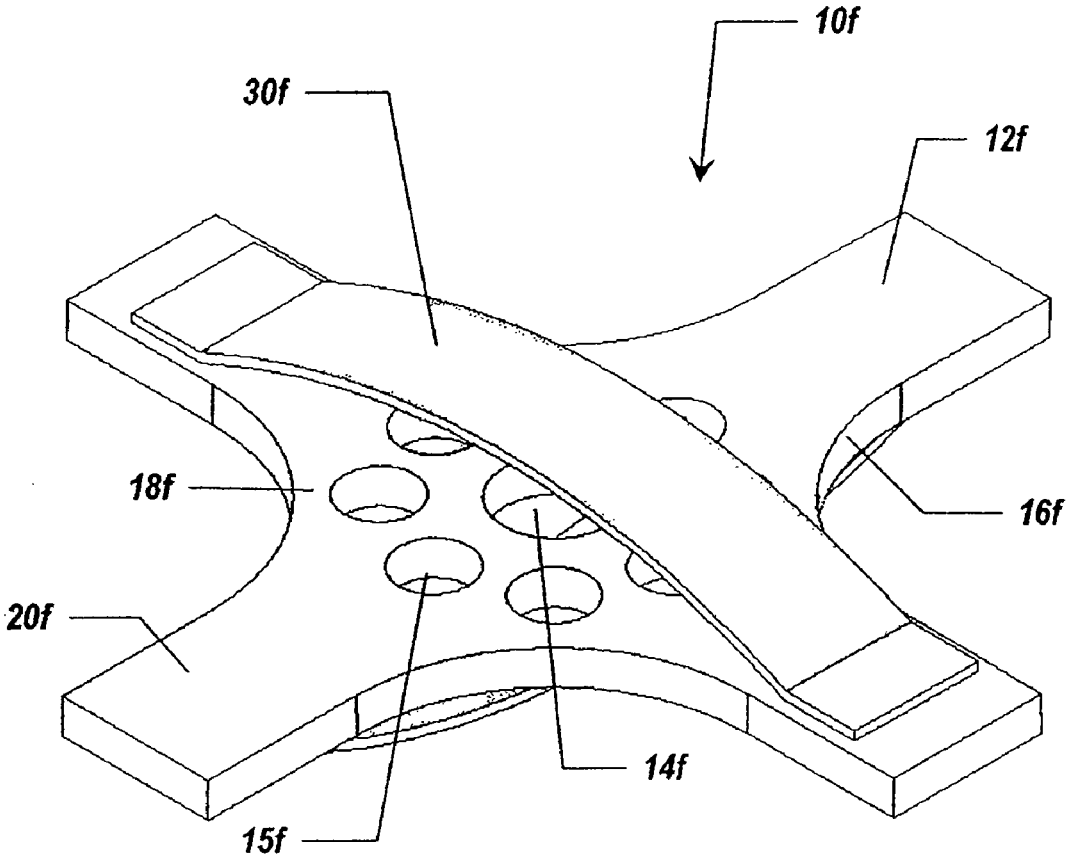
Figure 7B:
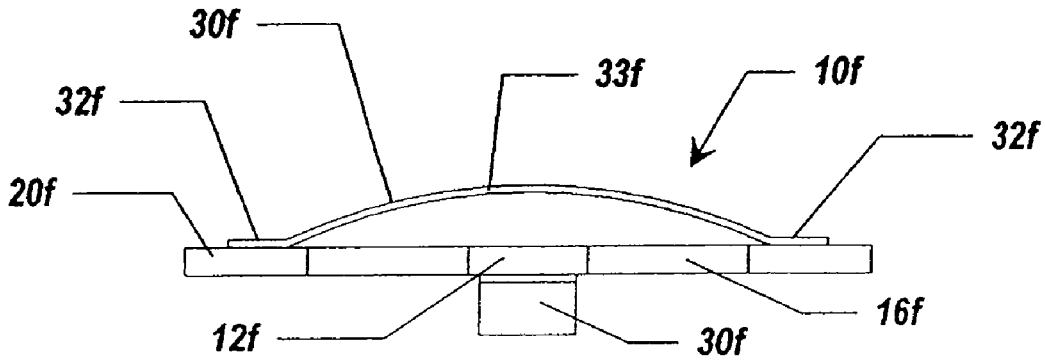
Figure 7C:
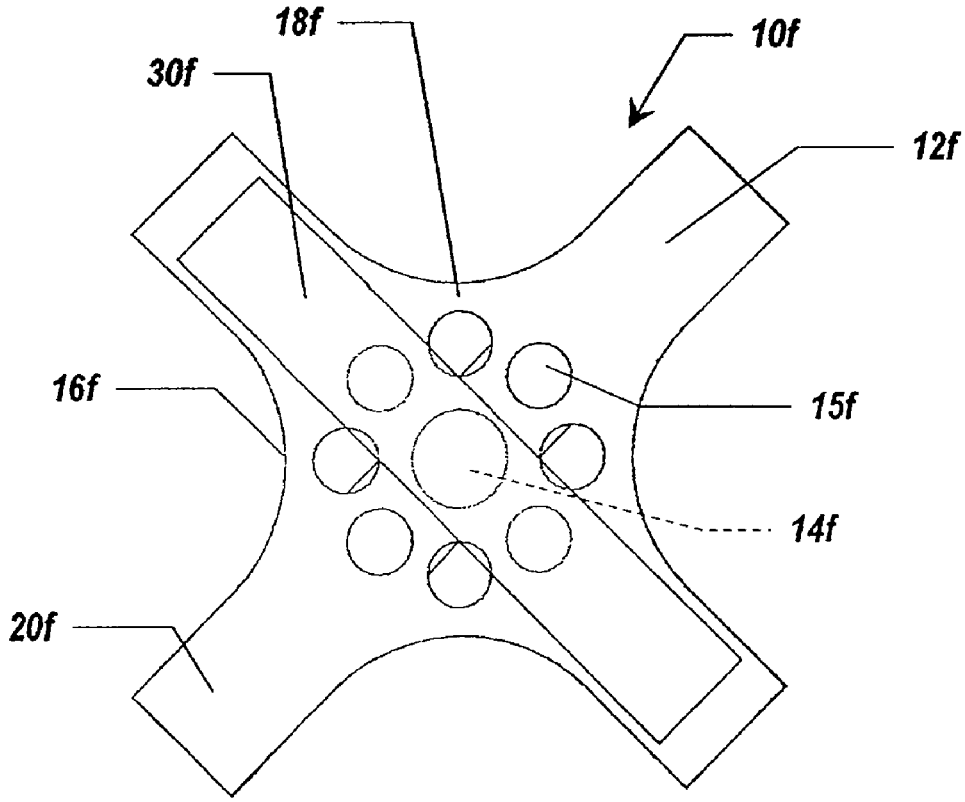
Figure 8A:
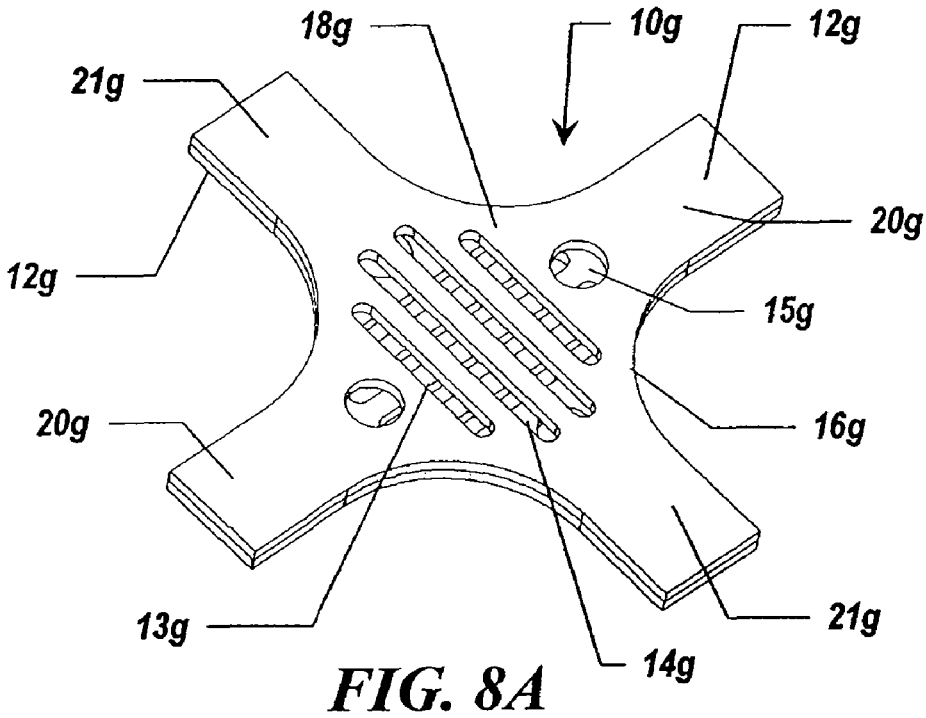
Figure 8B:
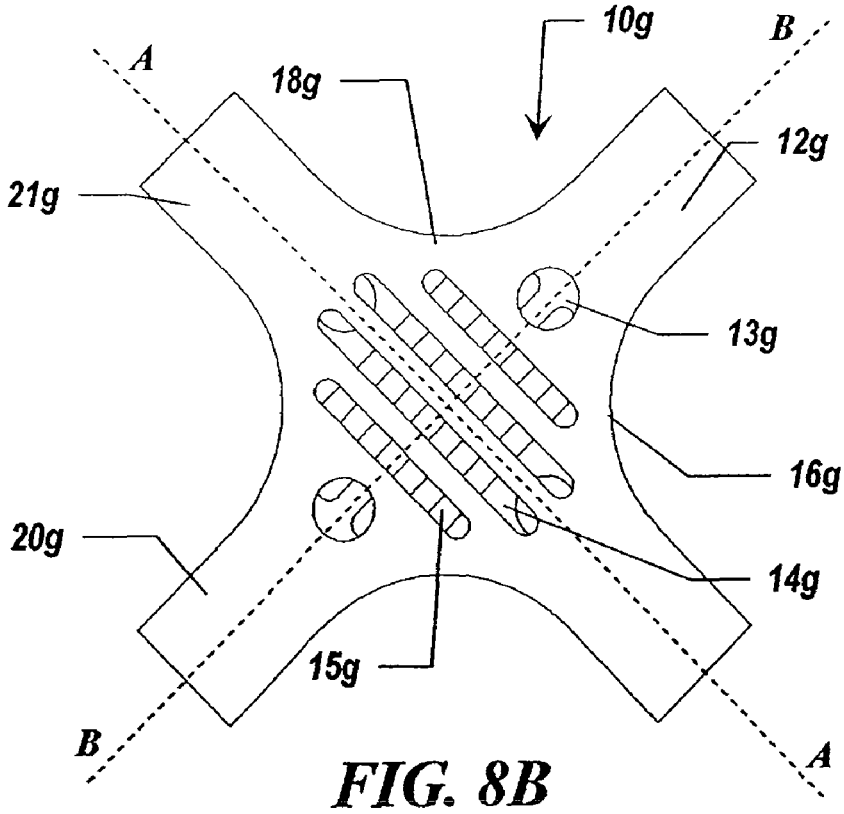
Figure 9:
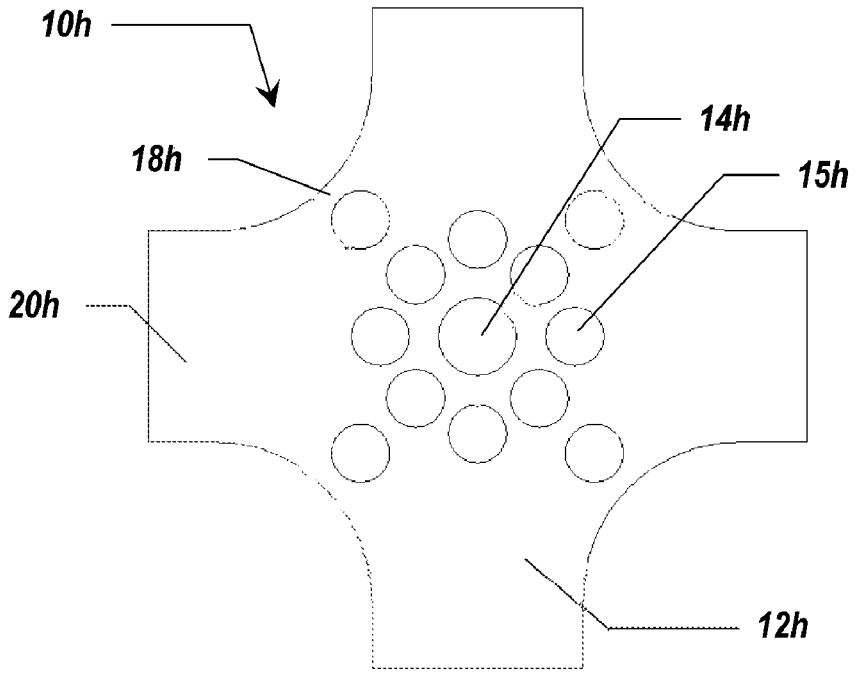

FIGS. 7-9 illustrate still other example embodiments of seismic dampers according to aspects of the present invention, in which multiple perforations and/or apertures may be used instead of a single perforation or aperture in the plate. FIG. 7, for instance, illustrates a seismic damper 10*f* that includes a flat plate 12*f* having one or more internal perforations or apertures 14*f*, 15*f* and one or more cut-outs 16*f* formed in an otherwise substantially square plate. Multiple apertures or perforations may be desirable in various applications. For example, multiple such apertures may add shear and twist. Such shear and twist can then dissipate the energy within the seismic damper as opposed to having it spread through the structure to which the damper is attached. Additionally, as can be seen in the illustrated embodiment, the corners of the square plate may optionally be removed by forming cut-outs 16*f* to form a plate 12*f* that is generally cross-shaped. As discussed herein, this embodiment is merely exemplary as numerous other configurations are possible for a seismic damper according to the present invention, including at least those discussed herein relative to FIGS. 1A-1D, 3A-6, and 8-13B.

As further illustrated in FIG. 7, a central aperture 14*f* may be formed at or about the center of plate 12*f*, and is optionally centered between tabs 20*f* and nodes 18*f* of seismic damper 10*f*. In this example embodiment, a generally circular aperture 14*f* is formed with its center on the center of flat plate 12*f*, although this is exemplary only, and in other embodiments there may be no aperture formed on the center of flat plate 12*f*, multiple apertures may be formed around the center of flat plate 12*f*, and/or apertures formed therein may have non-circular configurations.

As also illustrated in this embodiment, a series of additional perforations/apertures 15*f* may also be formed around, but not on, the center of plate 12*f*. By way of example only, additional perforations 15*f* may be placed around the perimeter of the central aperture 14*f* in a regular or irregular fashion. In FIG. 7, for example, the circular perimeter apertures 15*f* are offset around the perimeter of central aperture 14*f* at substantially equal angular offsets. More particularly, in the illustrated embodiment there are eight perimeter apertures 15*f* offset at forty-five degree intervals. Of course, more or fewer apertures may be used. Additionally, while a single layer of perimeter apertures 15*f* is illustrated, there may be successive layers of perimeter apertures, such that there may be additional apertures around the perimeter of apertures 15*f* (see, e.g., FIGS. 8 and 9).

Accordingly, it will be appreciated in view of the disclosure herein that apertures 14*f*, 15*f* can be formed in plate 12*f* in virtually any configuration, shape or pattern. For example, while apertures 15*f* are formed around aperture 14*f* in a substantially circular manner, they could also vary in their distance from central aperture 14*f*, and could even intersect central aperture 14*f*. Additionally, the sizes can be varied. Thus, while central aperture 14*f* can have a size greater than perimeter apertures 15*f*, this is exemplary only. In other embodiments, each of apertures 14*f*, 15*f*, is of about the same size, central aperture 14*f* is smaller than perimeter apertures 15*f*, or central aperture 14*f* may be smaller than some, but larger than other, of perimeter apertures 15*f*. Indeed, as reflected herein, central aperture 14*f* can be entirely omitted in some embodiments.

As also noted herein, seismic damper 10*f* can operate by absorbing energy such that it is focused at the nodes 18*f* formed between the tabs 20*f*. In the illustrated embodiment, for example, nodes 18*f* are formed in the portion of flat plate 12*f* that narrows between cut-outs 16*f* and perimeter apertures 15*f*. It will be appreciated that while stresses concentrate in this area, it does not mean or require that all stresses be applied only to nodes 18*f*. Indeed, as discussed herein, tabs 20*f* may also expand such that some of the stresses are absorbed by tabs 20*f*. Additionally, some stresses may also act in other locations such as, for example, in the areas between perimeter apertures 15*f* and the central aperture 14*f* or the center of plate 12*f*.

Another embodiment of a seismic damper 10*g* is illustrated in FIG. 8, and also includes multiple perforations or apertures 14*g*, 15*g* formed therein. In particular, in the illustrated embodiment, an aperture 14*g* is formed approximately in the center of plate 12*g*. Additionally apertures 15*g* are then formed in a radiating pattern such that they circumferentially surround aperture. For example, a first set of eight apertures 15*g* may be formed around the perimeter of aperture 14*g*. These eight apertures 15*g* may be offset at equal or unequal intervals, although in the illustrated embodiment they are all offset at approximately forty-five degrees from adjacent apertures 15*g*.

As further illustrated in this embodiment, additional apertures may also be positioned around the first set of eight apertures. In this embodiment, for instance, an additional eight apertures 15*g* are formed circumferentially around the first set of eight apertures 15*g*. The angular offset of the second set of apertures 15*g* may also be varied. As illustrated, the second set of apertures 15*g* may be aligned with the first set of eight apertures 15*g* so as to form radii that radiate outward from central aperture 14*g*. In other embodiments, however, the second set of apertures 15*g* may be otherwise offset (e.g., offset 22.5 degrees from first set of apertures 15*g*). In still other embodiments, there may be additional apertures. For example, there may be sixteen apertures in the second ring around central aperture 14*g*.

In one example embodiment, central aperture 14*g* is larger than any of surrounding apertures 15*g*. For example, aperture 14*g* may have a two-inch radius, while each of apertures 15*g* have a radius of one-and-a-half inches. Moreover, there may be unequal or equal spacing between apertures 14*g*, 15*g*. For instance, in the illustrated embodiment, each of the first set of eight apertures may have a distance of about an inch between its circumference and the circumference of central aperture 15*g*. An equal distance, or a different distance, may also be used for the distance between the circumferences of the first set of eight apertures, and the second set of eight apertures 15*g*.

Still another embodiment of an exemplary seismic damper 10*h* is illustrated in FIG. 9. In this embodiment, seismic damper 10*h* is similar to the seismic damper 10*g* of FIG. 8 (which has seventeen apertures), but in this embodiment seismic damper 10*h* has only thirteen apertures. Of course, the illustrated embodiment is merely exemplary and other numbers and configurations of apertures may be used.

In particular, FIG. 9 illustrates a seismic damper 10*h* that includes a flat plate 12*h* having a plurality of apertures 14*h*, 15*h* formed therein. Such apertures 14*h*, 15*h* may be of varying or consistent sizes as discussed elsewhere herein. In this example embodiment, central aperture 14*h* is formed in a center of plate 12*h* and is the largest of apertures 14*h*, 15*h*. Additional, smaller apertures 15*h* then extend radially from central aperture 14*h* towards nodes 18*h* and tabs 20*h*.

In the particular embodiment illustrated in FIG. 9, a series of eight apertures 15*h* are formed around the outer perimeter of central aperture 14*h* at angular intervals of forty-five degrees, while also being radially offset from central aperture 14*h*. The amount of the radial offset can vary. For instance, in the illustrated embodiment, the radial offset of four of apertures 15*h* may be less than the radius of apertures 15*h*, while another four apertures 15*h* may be offset from central aperture 14*h* by a distance about equal to the radius of apertures 15*h*.

As further illustrated in this embodiment, various additional apertures 15*h* extend radially outward beyond the first set of apertures surrounding central aperture 14*h*. In this embodiment, only four apertures 15*h* form the second set of apertures 15*h*. In particular, in this embodiment, four apertures 15*h* are angularly offset at ninety degree intervals and are aligned with the four apertures 15*h* in the first set of apertures 15*h* that are relatively closer to central aperture 14*h* (i.e., those in this embodiment that have a radial offset less than their own respective radius). As will also be noted, the apertures 15*h* radiating furthers outward are on radial lines that generally are directed towards the center of nodes 18*h*, rather than towards tabs 20*h*. This is merely exemplary, however, and in other embodiments there may be more apertures 15*h* directed towards tabs 20*h* than towards nodes 18*h*.

Figure 10A:
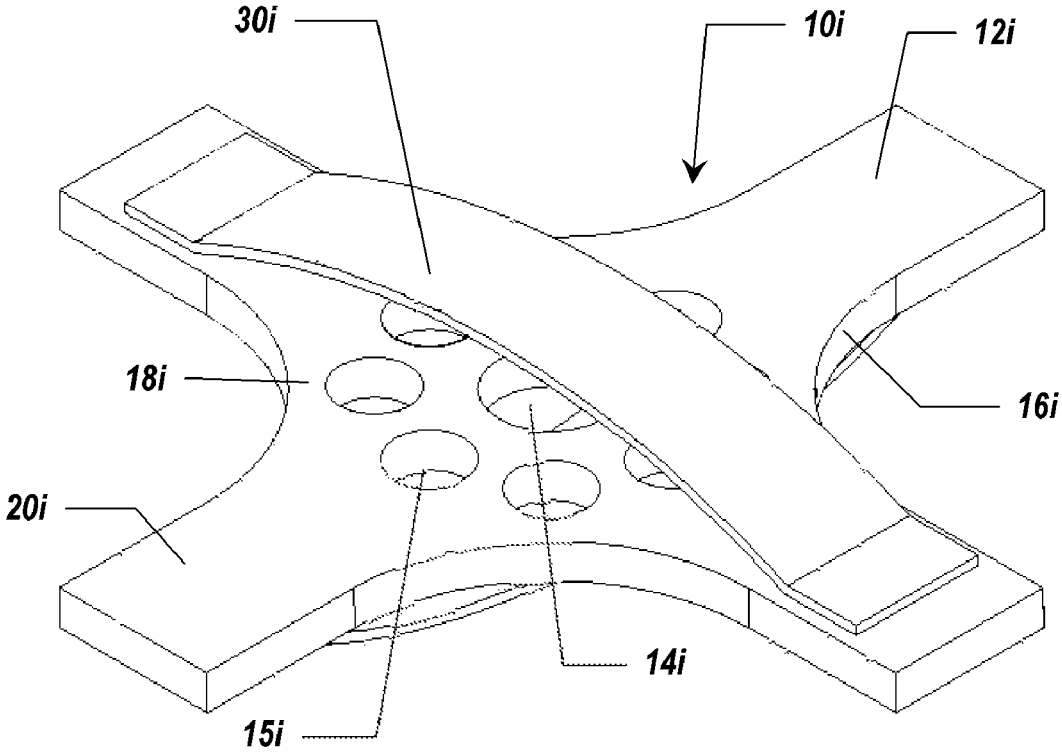
FIG. 10A illustrates a perspective view of a seismic damper according to another embodiment of the present invention, and which includes a pair of tension straps.
Figure 10B:
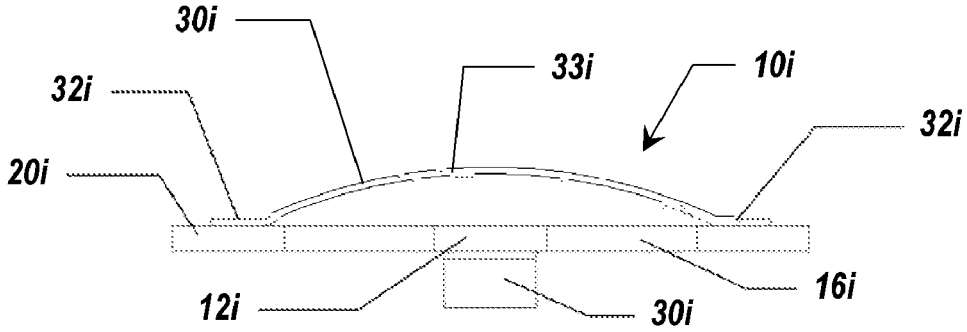
FIG. 10B illustrates a side view of the seismic damper of FIG. 10A.

FIGS. 10A, 10B illustrate yet another example embodiment of a seismic damper according to embodiments of the present invention, in which a strap 30*i* can be attached to at least one side of plate 12*i*. More particularly, in the illustrated embodiment shown best in FIGS. 10A and 10B, a strap 30*i* is attached to each of the opposing surfaces of plate 12*i*. While the illustrated embodiment illustrates the straps 30*i* as being attached to the top and bottom surfaces of plate 12*i*, it will be appreciated that this orientation is exemplary only and that plate 12*i* could be oriented such that straps 30*i* are attached to a top surface, bottom surface, left surface, right surface, front surface, back surface, and/or any other arbitrarily defined surface.

In one embodiment, straps 30*i* can be formed of a thin metal (e.g., steel, aluminum, etc.) and attached to two tabs 20*i* of plate 12*i*. In this particular exemplary embodiment, plate 12*i* includes four tabs 20*i*, and a strap 30*i* on the top surface attaches to two diagonally opposed tabs 20*i*, while the strap 30*i* on the bottom surface also attaches to two diagonally opposed tabs 20*i*. Thus, the straps 30*i* can attach to two tabs 20*i* that are not adjacent to each other, but which are separated by at least one tab 20*i* and, in this embodiment, two nodes 18*i*. Of course, a strap 30*i* could also be attached to two adjacent tabs, between nodes rather than tabs, between a node and a tab, or in any other suitable manner.

The straps 30*i* may be connected to plate 12*i* in any suitable manner as will be appreciated by one of ordinary skill in the art in view of the disclosure herein. For example, in the embodiment best illustrated in FIG. 10B, straps 30*i* include a connection portion 32*i* at each end of strap 30*i* to facilitate connection of strap 30*i* to plate 12*i*. For instance, in this embodiment, connection portion 32*i* is substantially flat and lies along the surface of plate 12*i*, to provide a surface along which strap 30*i* can easily be connected by welding, soldering, brazing, by using mechanical fasteners, or in any other suitable manner.

In this embodiment, and between the connection portions 32*i*, strap 30*i* also includes an arched portion 33*i*. In one aspect, arched portion 33*i* provides additional strength to seismic damper 10*i*, particularly at the point where seismic damper 10*i* would otherwise be near failure. For example, as described previously, including at least in the discussion related to FIG. 2, a seismic damper such as seismic damper 10*i* may be attached to a support system having cross-braces. As a seismic or other force is applied to those braces, one brace may experience tension and expand/lengthen, while the other brace undergoes compression and shortens/contracts.

When the tabs 20*i* which are connected to strap 30*i* undergo tension and expand, they likewise can cause strap 30*i* to expand. This expansion in strap 30*i* can thus cause arched portion 33*i* to lengthen, thereby reducing the amount of arch. In this manner, tension can cause the strap 30*i* to straighten. In general, strap 30*i* may provide the greatest resistance to the tensile forces on tabs 20*i* when strap 30*i* has undergone sufficient tension and elongation such that it has completely straightened out, or almost completely straightened out. This may also be pre-calculated. For example, when the plate 12*i* has elongated to a pre-calculated elongation length, straps 30*i* may then be almost completely straight, and can also thus begin to take a significant amount of load away from the plate 12*i*. This pre-calculated elongation length may, or may not, generally correspond to an elongation length at which failure of plate 12*i* is expected. In one embodiment, therefore, a strap 30*i* may straighten to provide its greatest absorption of energy when plate 12*i* has undergone a large amount of deformation and elongation, and is near failure. In either event, however, the straightening of the straps 30*i* can dissipate additional energy above and beyond what is performed by plate 12*i* alone.

As further discussed herein, often the tensile and compressive loading is cyclical in nature, such that while a strap 30*i* may at one point in a cycle undergo tension and elongate, in another point in the cycle the same strap 30*i* may undergo compression and contract. With the cyclical loading of plate 12*i*, the tabs 20*i* also undergo corresponding cycles of tension and compression.

In one embodiment, therefore, straps 30*i* can be configured to act along each of the different loading axes. For instance, in the illustrated embodiment a strap 30*i* is connected to plate 12*i* along the top surface of plate 12*i* in one diagonal direction and along one loading axis, while a second strap 30*i* is connected to plate 12*i* along the bottom surface of plate 12*i* in a different diagonal direction and along a different loading axis. In this exemplary case, the diagonal directions and loading axes are perpendicular, and the straps 30*i* therefore extend in respective directions that are also perpendicular to one another.

In this manner, regardless of the loading axis of plate 12*i*, straps 30*i* can be utilized to take some of the load away from plate 12*i*, and can be particularly useful when dissipating energy at the point plate 12*i* is near failure. Straps 30*i* may be referred to herein as tension straps, although it will be appreciated that straps 30*i* are not limited to operating under tension, and at times may also be acted upon under compression in a cyclical loading system. In such an embodiment such as that illustrated in FIGS. 10A, 10B, for example, while one strap 30*i* is in tension and elongates and/or straightens, another strap 30*i* may be under compression such that it contracts and/or increases its arch.

It should be appreciated in view of the disclosure herein that the embodiment illustrated in FIGS. 10A, 10B are merely exemplary, however, and that other embodiments are possible. For example, in some cases straps 30*i* may be attached to the same surface of plate 12*i* and extend in parallel and/or perpendicular directions.

As further illustrated in FIG. 10A and as discussed elsewhere herein, a seismic damper 10*i* with one or more straps 30*i* can have any suitable configuration. In the embodiment illustrated in FIG. 10A, for example, a flat plate 12*i* having one or more internal perforations or apertures 14*i*, 15*i* and one or more cut-outs 16*i* along the edges of flat plate 12*i* is used. In the illustrated embodiment, for instance, four cut-outs 16*i* are formed in an otherwise substantially square plate, while the corners of the substantially square plate are also optionally removed, thereby forming a plate 12*i* that is generally cross-shaped. Indeed, flat plate 12*i* has a configuration similar to that discussed relative to FIG. 8; however, any other seismic damper discussed herein or understood in view of the disclosure herein may be used.

It should be appreciated in view of the disclosure herein that the embodiments illustrated herein are merely exemplary, however, and that other embodiments are possible. For example, in some cases straps 30*i* may be attached to the same surface of plate 12*i* and extend in parallel and/or perpendicular directions.

Figure 11:
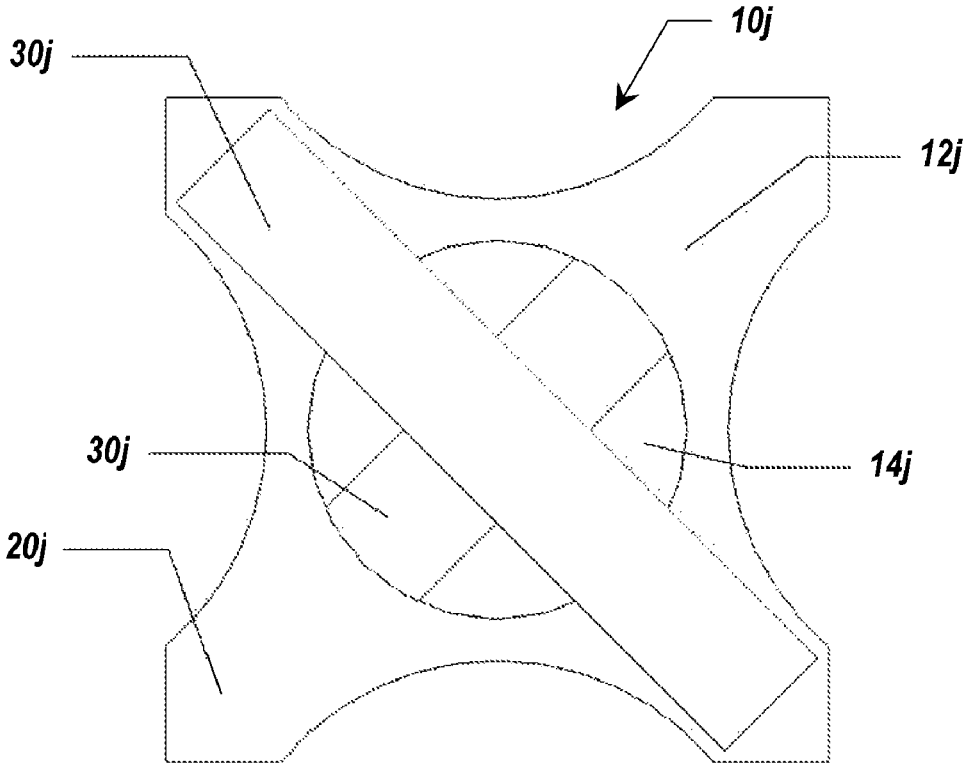
FIG. 11 illustrates a top view of an alternative embodiment of a seismic damper with a pair of tension straps.

Another example of a seismic damping device 10*j* that utilizes one or more straps 30*j* is illustrated in FIG. 11. In particular, FIG. 11 illustrates an example embodiment in which seismic damping device 10*j* includes a flat plate 12*j* having a single, central aperture 14*j* formed therein. In the embodiment illustrated in FIG. 11, a plate 12*j* similar to that described above in FIGS. 1A-1D is used in connection with straps 30*j*. As noted herein, it can thus be seen that straps 30*j* may be used with a flat plate having a variety of configurations, including any of the configurations disclosed herein or which may be learned from a review of the discussion herein.

Moreover, in the illustrated embodiment, straps 30*j* may again be positioned on opposing sides of plate 12*j*, although this is exemplary only. Further, as described previously with respect to FIGS. 10A, 10B, straps 30*j* may be offset so that they connect to different tabs 20*j*.

Figure 12A:
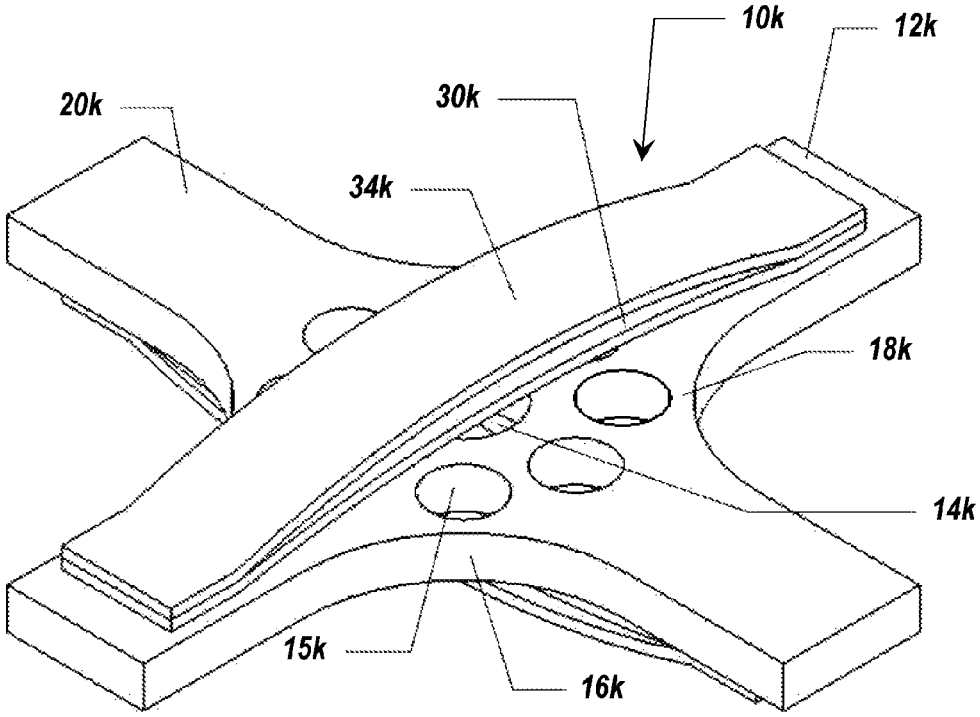
FIG. 12A illustrates a perspective view of a seismic damper according to another embodiment of the present invention, and which includes nested tension straps.
Figure 12B:
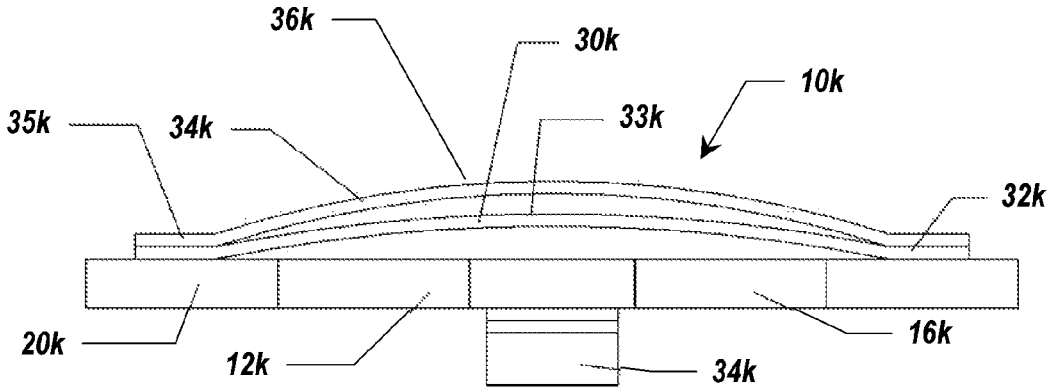
FIG. 12B illustrates a side view of the seismic damper of FIG. 12A.

Referring now to FIGS. 12A and 12B, another example embodiment of a seismic damper 10*k* is shown and described. As noted previously, various straps 30*k*, 34*k* may be used in connection with a seismic damper, and may even be placed on the same side in a parallel fashion. In the illustrated embodiment, there are multiple straps 30*k*, 34*k* on each of two faces of flat plate 12*k*, and are parallel and nested.

In particular, a flat plate 12*k* is provided that includes a plurality of tabs 20*k* at least partially defined by a plurality of cut-outs 16*k* disposed between each of tabs 20*k*. In this embodiment, cut-outs 16*k* cause flat plate 12*k* to neck down towards apertures 14*k*, 15*k* and form nodes 18*k* where stresses placed on seismic damper 10*k* can be distributed.

In one embodiment, straps 30*k* can be formed of a thin material (e.g., metals, alloys, composites, polymers, organic materials, etc.) and attached to two tabs 20*k* of plate 12*k*. In this particular exemplary embodiment, plate 12*k* includes four tabs 20*k*, and a strap 30*k* that attaches to the top surface and to two diagonally opposed tabs 20*k*, while a strap attached to the bottom surface of plate 12*k* also attaches to two diagonally opposed tabs 20*k*. Thus, the straps 30*k* can attach and optionally arch between two tabs 20*k* that are not adjacent to each other, but which are separated by at least one tab 20*k* and, in this embodiment, two nodes 18*k*. Of course, a strap 30*k* could also be attached to two adjacent tabs, between nodes rather than tabs, between a node and a tab, or in any other suitable manner.

Moreover, as shown in FIGS. 12A and 12B, an additional strap 34*k* may also be attached to strap 30*k*, and therefore at least indirectly attached to plate 12*k*. In this embodiment additional strap 34*k* attaches to strap 30*k* such that it is parallel to and disposed above (or below in the case of the strap attached to the bottom surface of plate 12*k*) strap 30*k*. As will be appreciated in view of the disclosure herein, strap 34*k* can also arch between the two tabs to which it is connected and can have a length and/or arc height that is greater than that of strap 30*k*.

The straps 30*k*, 34*k* may be connected to plate 12*k* in any suitable manner as will be appreciated by one of ordinary skill in the art in view of the disclosure herein. For example, in the embodiment best illustrated in FIG. 12B, straps 30*k* include a connection portion 32*k* at each end of strap 30*k* to facilitate connection of strap 30*k* to plate 12*k*, and straps 34*k* include a connection portion 35*k* at each end of strap 34*k* to facilitate a connection of strap 34*k* to strap 30*k*. In this manner, connection portions 35*k* can also attach strap 34*k* to plate 12*k*. For instance, in this embodiment, connection portions 32*k*, 35*k* are substantially flat and lie along the surface of plate 12*k* and the top surface of connection portion 32*k*, respectively, to provide a surface along which straps 30*k*, 34*k* can easily be connected by welding, soldering, brazing, by using mechanical fasteners, or in any other suitable manner. Further, while strap 34*k* is shown in this embodiment as being indirectly attached to plate 12*k* by means of attachment to strap 30*k*, in other embodiments strap 34*k* may be directly attached to plate 12*k*.

In this embodiment, and between the connection portions 32*k*, 35*k*, straps 30*k*, 34*k*, also include arched portions 33*k*, 36*k*. In one aspect, arched portions 33*k*, 36*k* provide additional strength to seismic damper 10*k*, particularly at the points where seismic damper 10*k* would otherwise be near failure. For example, as described previously, including at least in the discussion related to FIG. 2, a seismic damper such as seismic damper 10*k* may be attached to a support system having cross-braces. As a seismic or other force is applied to those braces, one brace may experience tension and expand/lengthen, while the other brace undergoes compression and shortens/contracts.

When the tabs 20*k* connected to straps 30*k*, 34*k* undergo tension and expand, they likewise can cause straps 30*k*, 34*k* to expand. This expansion in straps 30*k*, 34*k* can thus cause arched portions 33*k*, 36*k* to lengthen, thereby reducing the amount of arch. In this manner, tension can cause the straps 30*k*, 34*k* to straighten. In general, straps 30*k*, 34*k* may provide the greatest resistance to the tensile forces on tabs 20*k* when straps 30*k*, 34*k* have undergone sufficient tension and elongation such that they have completely straightened out, or have almost completely straightened out. This may also be pre-calculated. For example, when the plate 12*k* has elongated to a pre-calculated elongation length, straps 30*k* and/or straps 34*k* may then be almost completely straight, and can also thus begin to take a significant amount of load away from the plate 12*k*. This pre-calculated elongation length may, or may not, generally correspond to an elongation length at which failure of plate 12*k* is expected. In one embodiment, therefore, a strap 30*k* and/or strap 34*k* may straighten to provide the greatest absorption of energy when plate 12*k* has undergone a large amount of deformation and elongation, and is near failure. In another embodiment, strap 30*k* may straighten to provide is greatest absorption of energy when plate 12*k* has undergone a large amount of deformation but is not yet at a failure point. At that point, strap 30*k* can dissipate energy and provide resistance to further deformation of plate 12*k*. In the event plate 12*k* continues to expand, strap 34*k* may also further straighten out. As additional elongation occurs, strap 34*k* may straighten to provide its greatest absorption of energy at about a point where failure is to occur. Thus, strap 30*k* can operate to resist elongation of plate 12*k* to the failure point, while strap 34*k* may operate to resist elongation of plate 12*k* when it is at or near the failure point. In any such event, however, the straightening of straps 30*k*, 34*ki* can dissipate additional energy above and beyond what is performed by plate 12*k* alone.

As further discussed herein, often the tensile and compressive loading is cyclical in nature, such that while straps 30*k*, 34*ki* may at one point in a cycle undergo tension and elongate, in another point in the cycle the same straps 30*k*, 34*k* may undergo compression and contract. With the cyclical loading of plate 12*k*, the tabs 20*k* also undergo corresponding cycles of tension and compression.

In one embodiment, therefore, straps 30*k* and 34*k* can be configured to act along each of the different loading axes. For instance, in the illustrated embodiment, straps 30*k*, 34*k* on the top surface are parallel and nested while being connected to the top surface of plate 12*k* in one diagonal direction and along one loading axis, while a second set of straps 30*k*, 34*k* are connected to plate 12*k* along the bottom surface of plate 12*k* in nested configuration and in a different diagonal direction and along a different loading axis. In this exemplary case, the diagonal directions and loading axes are perpendicular, and the nested sets of straps 30*k*, 34*k* therefore extend in respective directions that are also perpendicular to one another. In this manner, regardless of the loading axis of plate 12*k*, straps 30*k*, 34*k* can be utilized to take some of the load away from plate 12*k*, and can be particularly useful when dissipating energy when plate 12*k* is moving towards and/or near failure.

Notably, while the multiple straps 30*k*, 34*k* are shown on each side of plate 12*k* in a nested configuration, in other embodiments straps 30*k*, 34*k* may be in perpendicular configurations on the same sides of plate 12*k*. As discussed herein, there may be more than four tabs on a flat plate, or tabs may not be aligned perpendicularly, so straps 30*k*, 34*k* may also be aligned orthogonally, such that they are neither parallel nor perpendicular. It will thus be appreciated that multiple straps may be used, and there may also be one or more straps on a single side of a seismic damping plate such as plate 12*k*.

Furthermore, while straps 30*k*, 34*k* are illustrated as being nested on perforated plate 12*k*, this is itself also merely optional. For example, in another embodiment, straps 30*k*, 34*k* may be a stand-alone device that is separate from a plate damper or any other damping device. For instance, nested straps 30*k*, 34*k* could be used as the brace and damper by itself, and the same basic behavior relative to absorbing seismic energy could be experienced. In such a case, strap 30*k* may, for example, be substantially straight and connected directly to a diagonal extending from a joint of a frame. The additional strap 34*k* could again be curved or bent in some manner, and welded, bolted, or otherwise attacked attached to the diagonal and/or strap 30*k*. Moreover, such a case may allow strap 30*k* to be an interior strap for two nested straps 34*k*. In particular, a nested strap 34*k* could be attached to opposing sides of strap 30*k* to provide a nested strap structure with only three straps.

It should also be appreciated in view of the disclosure herein that such an embodiment of stand-alone straps 30*k*, 34*k* could use any number of straps and nested straps, to dissipate seismic energy. Moreover, additional layers of curved straps could be attached in pairs on one or both sides of a frame and/or interior strap or plate. The straps could therefore be attached to a device in a cruciform shape by, for example, rotating the direction of the nested straps on diagonals of a frame. Additionally, such an embodiment could easily be configured to operate on a system where the height and/or length of the frame system were not equal.

The use of one or more straps on one or more sides of a frame system is thus configurable and may be modified to suit any of a variety of different applications. The straps disclosed herein, whether nested, rotated relative to each other, or otherwise configured, may also be added to still other systems to enhance their performance. For instance, such straps may be employed in conjunction with a buckling restrained brace (BRB) system. Such BRB systems can be used as braces in buildings and other structures, and particularly as concentric bracing systems. They operate with interior steel cores that can resist the structure's side sway in tension and compression. By adding straight, curved, bent, or other straps to the BRB system, the straps can be designed to add secondary stiffness in the tension mode to limit excessive deformations and/or to provide additional redundancy to preclude structural collapse. Such could easily be made operational by welding, bolting, or otherwise attaching a strap (e.g., curved strap 30*k* or 34*k*) to an outer casing of the BRB system, and extending to the main beam and column system gusset plate assembly that may be provided at each end of the brace.

Figure 13:
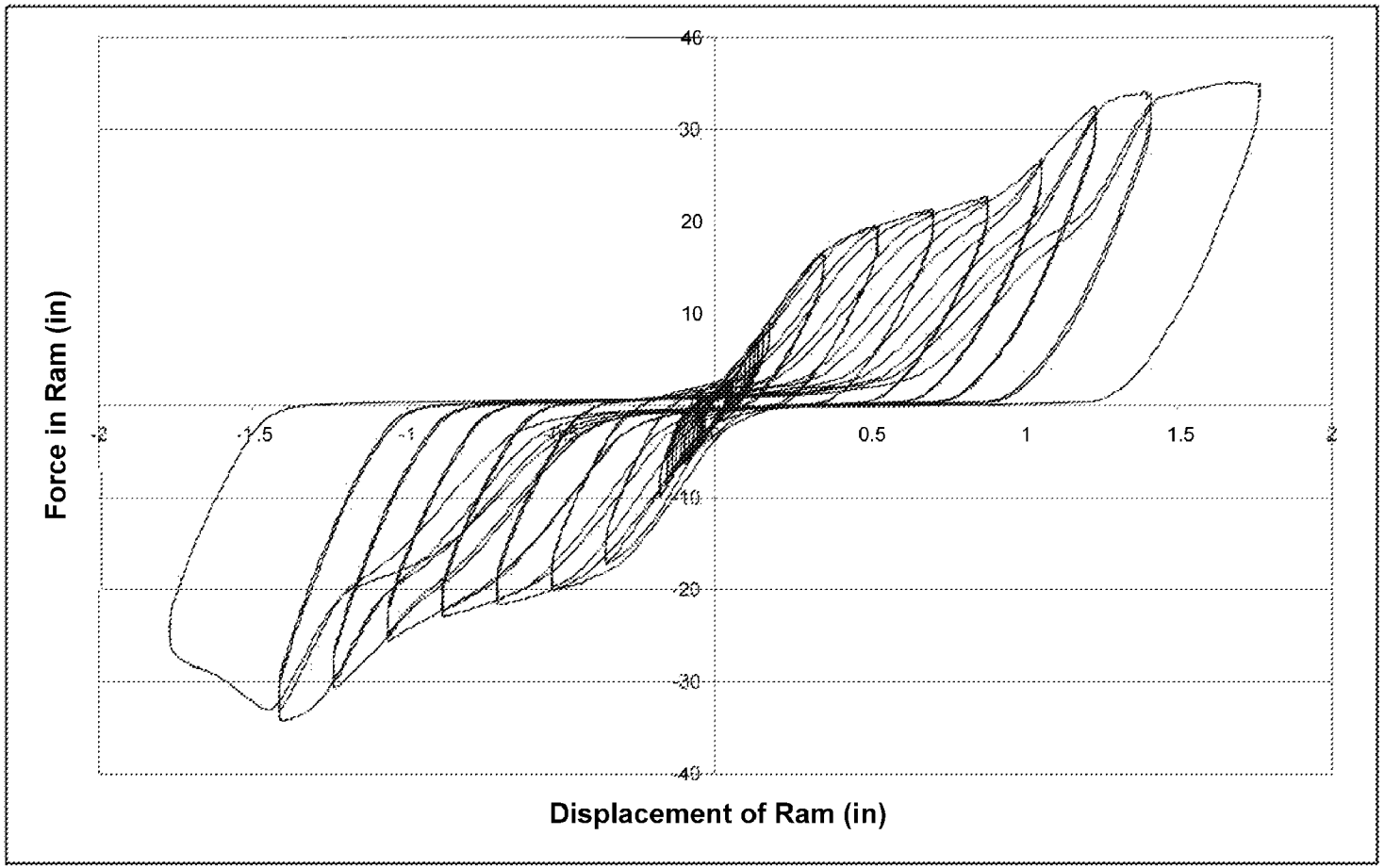
FIG. 13 illustrates graphically illustrates displacement of a test performed on a seismic damper similar to that illustrated in FIGS. 10A and 10B.

FIG. 13 provides a hysteretic diagram for a test run on a seismic damper similar to seismic damper 10*i* in FIGS. 10A, 10B, and graphically illustrates example test results received. In particular, the graphical results were obtained using a testing scenario providing conditions similar to that illustrated in FIG. 2, in which a frame was built and pin joints used to provide a sufficient range of motion without applying moment forces to frame joints. A horizontal actuator was then placed in-line with a top frame member. The horizontal actuator provided a lateral force of twenty kips, and had a stroke of plus or minus seven inches. A combination of strain gauges and displacement-measuring linear variable differential transformers (LVDT's) were also placed on the tension members connecting the sample dampers to the test frame, and were utilized to calculate forces in the tension members without placement of strain gauges on the seismic damper itself. The LVDT's were used to quantify the displacement of the loading frame and the elongation of the seismic damper. In the test scenario, the example seismic damper was also connected to the testing apparatus by using a clevis and turnbuckle pin connection arm set-up that allowed for pretensioning connecting arms using the turnbuckles.

In an initial test of the system, a steel strap was connected to a steel seismic damper, and the strap had a length designed to provide increased strength when the plate reached seventy-five percent of its ductility. That is to say that at seventy-five percent of the plate's ductility, the strap was designed to flatten out and carry the tensile load. The test was then run until failure.

Notably, while the test was run, stress concentrations were evident at both external nodes (e.g., nodes 18*i* in FIG. 10A)

and at internal nodes (i.e., portions of flat plate 12*i* between central aperture 14*i* and outlying apertures 15*i*.) Such stress concentrations produced a unique diamond shape centered within the nodes. Further, as failure was reached, failure occurred at the internal nodes prior to failure at the external nodes.

From the hysteretic diagram in FIG. 13, it can be seen that the first cycles in the test had relatively small displacements and are therefore concentrated in a small area in the center of the diagram. As subsequent cycles were performed, fewer and fewer cycles were needed to obtain increasingly greater displacements. Moreover, the test results are shown to be pinched in the center, and that the results in the negative and positive directions are nearly identical. Thus providing essentially symmetric results for positive and negative displacements.

The test results are depicted in the chart of FIG. 13. Looking at the upper right quadrant, it can be seen that starting at the origin (i.e., zero displacement and zero force), there is a generally linear region that extends upward, and which corresponds to a linear region of elastic deformation. In this particular test, the linear region extends to about 0.3 inch displacement and 15 inches in Force, at which location a transition occurs. At this point, the diagram illustrates that the damper of the example test transitioned from the linear region to a yielding region. It will be noted in the illustrated diagram that the yielding region is not a perfect plateau, but that it also increases along its length. In particular, the yielding region extends to about 0.8 inch displacement and 22 inches in Force. Additionally, in this example the yielding region is curved and non-linear, although in other cases it may be linear but with a different slope than that in the initial linear region.

At the end of the yielding region, the chart illustrates an additional change in slope. More particularly, a secondary stiffness region begins at the end of the yielding region and extends to about 1.0 inch displacement and 25 inch Force. A second linear region is further shown starting at the end of the secondary stiffness region, and extending to about 1.25 inch displacement and 32 inches in Force. A second yielding region then begins at the end of the second linear region and continues upward on the diagram until failure at about 1.75 inch displacement and 35 inch Force.

As will be appreciated in view of the disclosure herein, there is a delayed stiffening of the material. In particular, FIG. 13 illustrates a chart that reflects a dampening device that begins to again stiffen at the end of the secondary stiffness region, and which doesn't then start to resemble a necking region of a traditional steel stress-strain diagram. An additional yielding region then follows. Additionally, the yielding regions in FIG. 13 are less sloped than their adjacent linear regions, but are not necessarily perfectly parallel. This could be due to the make-up and configuration of the test object itself, or due to strain hardening that starts to occur throughout the yielding region(s).

In one aspect, the illustrated diagram shows the effect of a tension strap connected to a damping device such as the perforated plate dampers disclosed herein. In particular, in the illustrated chart, the strap of the test device was configured to straighten out at approximately 0.75 inch elongation. It can be seen that at about that same point, the secondary stiffness region begins. At about the point where the strap straightens, the strap can begin to take a larger portion of the tensile load on the device. This can be seen in the hysteretic diagram in FIG. 13, where at the second linear region, the strap may begin to engage and take the tension, thereby carrying the bulk of the tension on the device. As the majority of the tension is transferred to the strap, the strap then begins to elongate, and first undergoes elastic deformation. The strap then can extend into plastic deformation in the second yielding region.

It will be appreciated therefore that tension straps can be applied to provide a number of different behaviors as illustrated in hysteretic diagrams such as that in FIG. 13. For example, while the illustrated embodiment includes test results for a plate having a single tension strap, a plate with multiple tension straps (e.g., the nested straps of FIGS. 12A and 12B) may exhibit a different behavior. For example, the nested straps may provide still another delayed region of stiffening such that there are three or more elastic regions within a stress-strain diagram for the device. Moreover, as the strap lengths, materials, and other aspects are modified, the points where the different regions begin and end can be modified. Indeed, in some embodiments, it may be possible to eliminate, or virtually eliminate, certain regions due to the design considerations given to particular straps. For instance, a separate secondary stiffness region may be entirely eliminated or a yielding region may be shortened or extended. In other cases, additional regions may be added. For example, the straps may have a length that engages after ultimate stress is obtained and delays stiffening until a necking region begins.

Figure 14A:
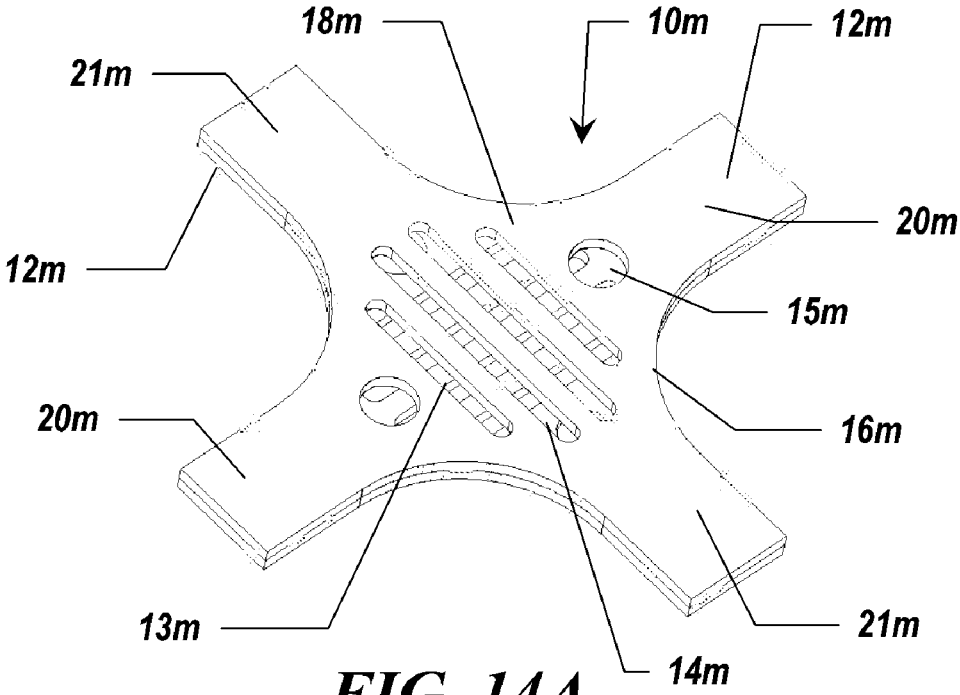
FIG. 14A illustrates a perspective view of another example embodiment of a seismic damper in which perforations in the seismic damper include slots, and in which two plates are affixed together at a ninety degree offset.
Figure 14B:
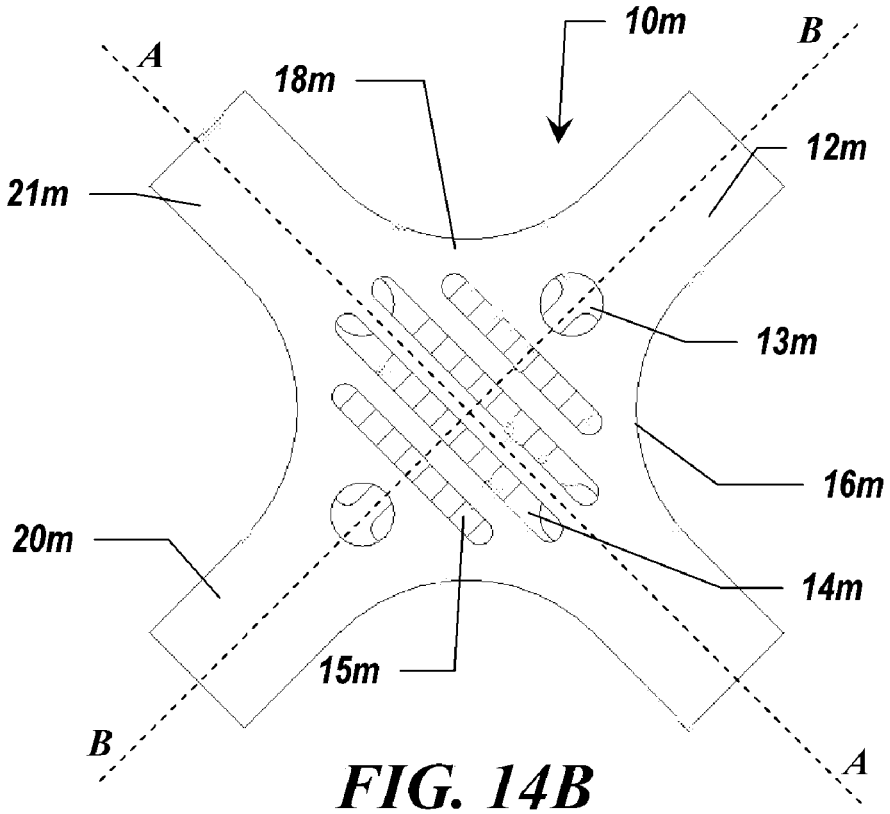
FIG. 14B illustrates the seismic damper of FIG. 14A as viewed from either the top or bottom.

Now turning to FIGS. 14A and 14B, yet another embodiment of a seismic damper 10*m* according to aspects of the present invention is disclosed. In particular, FIGS. 14A and 14B illustrate an exemplary seismic damper 10*m* having two plates 12*m* joined together and/or which have yet another alternate configuration of perforations 13*m*, 14*m*, 15*m*.

For example, in the illustrated embodiment, seismic damper 10*m* includes two plates 12*m* which are attached to each other on their respective top and bottom surfaces. As will be appreciated in view of the disclosure herein, each of flat plates 12*m* of FIGS. 14A and 14B is similar to flat plates 12*i* of FIGS. 10A, 10B, except that the strap 30*i* has been removed, and the perforations have different configurations. Furthermore, in some cases flat plates 12*m* may be about half the thickness as flat plate 12*i* as the two flat plates 12*m* are connected together.

More particularly, the embodiment illustrated in FIGS. 14A and 14B also shows a seismic damper in which the flat plates 12*m* are substantially square, but which have cut-outs 16*m* formed in the edges thereof, and the corners removed to form a substantially cross-shaped seismic damper 10*m*. As noted previously, this configuration is exemplary only, and aspects of this embodiment, including at least the use of two plates and the orientation and type of perforations, can equally be applied to any seismic damper illustrated herein.

As compared to flat plate 12*i* of FIGS. 10A, 10B, it will be appreciated that flat plates 12*m* of FIGS. 14A and 14B have removed the central aperture 14*i* and six of the eight perimeter apertures 15*i*. Instead, FIGS. 14A and 14B illustrate flat plates 12*m* which include a series of slots 13*m*, 14*m*, as well as two perimeter apertures 15*m* similar to two perimeter apertures 15*i* from seismic damper 10*i*. More particularly, the two perimeter apertures 15*m* are opposing apertures and offset at one-hundred eighty degrees, while being aligned with a center of tabs 20*m*.

More specifically, the illustrated embodiment includes a set of two central, elongate slots 14*m* which are centered around the center of flat plate 12*m*, and are reflectively symmetric about at least two axes of symmetry. In particular, elongate slots 14*m* are, in this embodiment, reflectively symmetric about a first axis of symmetry A-A which passes through the centers of opposing tabs 21*m*, and through the middle of the space between elongate slots 14*m*. A second axis of symmetry B-B passes through the centers of opposing tabs 22*m* and through the center of each of apertures 13*m*, 14*m*, and 15*m*.

A second set of elongate slots 15*m* is also illustrated in the example embodiment, and slots 15*m* are also symmetrical about the same two axes of symmetry. In this example, elongate slots are placed outward from the center of plate 12*m*, through which axis of symmetry A-A passes, and closer to tabs 20*m*. Additionally, elongate slots 15*m* can have a length which varies from that of elongate slots 14*m*. For instance, in the illustrated embodiment elongate slots 14*m* are longer than elongate slots 15*m*, although this is exemplary only. In other embodiments, for instance, elongate slots 15*m* may be longer than elongate slots 14*m*, or elongate slots 14*m*, 15*m* may be about the same length. In still other embodiments, there may be fewer or no axes of symmetry. For example, elongate slots 14*m*, 15*m* may have differing lengths, widths, configurations on opposing sides of axis of symmetry A-A or axis of symmetry B-B.

Optionally, one or more other apertures may also be included. For instance, in this embodiment, the two circular apertures 13*m* are also formed in plates 12*m* and are further offset from axis of symmetry A-A and the center of plate 12*m* (and which is generally shown by the intersection of axes of symmetry A-A and B-B). Apertures 13*m* may, however, be omitted entirely, or configured in other manners. For instance, in another embodiment, apertures may additionally or alternatively be formed near the ends of elongate slots 14*m*, 15*m*, closer to the center of plate 12*m*, between slots 14*m*, 15*m*, or in any other suitable or desired location.

In addition, it will be appreciated that the spacing between apertures 13*m*, 14*m* and 15*m*, whether in the form of slots, circles, or in any other shape, may also be substantially equal, or may be varied. Furthermore, while multiple slots and apertures are illustrated, the number, orientations and configurations may also be varied. For instance, in one embodiment slots may be formed on the same plate 12*m* so as to be perpendicular or orthogonal with respect to other slots. In another alternative, a single slot may be used and, for example, may be centered such that it runs along either illustrated axis of symmetry, or angularly offset with respect thereto. Accordingly, while the illustrated embodiment shows tabs 20*m* which are near apertures 13*m* and at least partially different than tabs 21*m* which are instead near the ends of slots 14*m*, in other embodiments each of the tabs is identical. In still other embodiments all of the tabs may be different, or other configurations may be used.

In the illustrated embodiment, the two plates 12*m* collectively form a substantially flat perforated member, although each single plate is also properly considered a substantially flat perforated member. In the collective use of plates 12*m*, it can be seen that plates 12*m* may each be substantially identical, such that when joined together, the tabs 20*m*, 21*m*, cut-outs 16*m*, and nodes 18*m* can be placed in alignment with each other. In some embodiments, identical perforations are also formed and, when plates 12*m* are aligned, perforations 13*m*, 14*m*, and 15*m* are also in alignment such that slots 13*m* in one plate 12*m* align with substantially identical slots in the other plate 12*m*, while slots 14*m* and apertures 15*m* in that plate 12*m* also align with substantially identical slots and apertures, respectively, in the other plate 12*m*.

In another embodiment, however, such as that illustrated in FIGS. 14A and 14B, the perforations of plates 12*m* may not be in substantial alignment. Such may occur where, for example, the perforations are not substantially identical. Alternatively, or in addition thereto, perforations may be out of alignment because one plate is rotated relative to the other plate.

The latter is the case in the illustrated embodiment, in which plates 12*m* are substantially identical, but in which perforations 13*m*, 14*m*, and 15*m* are out of alignment. In particular, as can best be seen in FIG. 14B, slots 13*m*, 14*m* in the top plate 12*m* run perpendicular to the equivalent slots in the bottom plate 12*m*. Similarly, apertures 13*m* of the top plate are out of alignment with the equivalent apertures in the bottom plate 12*m* and are, in this example, also rotated about the center of seismic damper 10*m* by ninety degrees. More specifically, top plate 12*m* is rotated ninety degrees with respect to bottom plate 12*m*, such that the axes of symmetry are also rotated with respect thereto. Thus, axis of symmetry A-A of top plate 12*m* is aligned with the equivalent of axis of symmetry B-B for bottom plate 12*m*, while axis of symmetry B-B of top plate 12*m* is aligned with the equivalent of axis of symmetry A-A for bottom plate 12*m*.

In describing the behavior of seismic damper 10*m*, only the top plate 12*m* will be described, although it will be appreciated that an equivalent discussion may be had with respect to the bottom plate 12*m*. More particularly, as noted above, plate 12*m* may be placed in tension or compression, or cyclically in both tension and compression. When plate 12*m* is placed in tension along axis A-A or another axis parallel to slots 13*m* or 14*m*, the material in the center of plate 12*m* can be placed in heavy tension. When plate 12*m* is placed in tension along axis B-B or another axis perpendicular to slots 13*m*, 14*m*, the force can be directed around the sides of slots 13*m*, 14*m*, causing the plate 12*m* to bend as it elongates. In such case, plate 12*m* could also experience contraction in the direction parallel to slots 13*m*, 14*m*.

Notably, when top plate 12*m* is combined with bottom plate 12*m* in the manner illustrated in FIGS. 14A and 14B, namely with the slots 13*m*, 14*m* of the two plates 12*m* out of alignment, and seismic damper 10*m* is placed in tension along either axis, a combination of the behaviors described above can occur. The top plate 12*m*, for example, may resist a tensile force with the material parallel to the force, while bottom plate 12*m* can elongate in the direction of the applied force and contract in the direction perpendicular to the applied force. When the force is released and the seismic damper 10*m* is pulled in tension along the perpendicular axis, the top plate 12*m* that experienced contraction can now be forced to elongate, while the bottom plate 12*m* that experienced elongation may now experience bending forces and/or contraction.

The foregoing examples are illustrative only and are not necessarily limiting of the application. For example, the embodiment disclosed with respect to FIGS. 14A and 14B, need not necessarily have a substantially flat member with two flat plates. In one example, only a single plate is used and has perforations extending fully therethrough. Such an example may additionally, or alternatively, also include a tension strap as described herein. In another embodiment, a single plate is used and perforations are formed to pass only partially through the thickness of the plate. In still other embodiments, additional plates can be combined so that three or more plates may be stacked or otherwise combined together.

Accordingly, in view of the various embodiments disclosed herein, it will be appreciated that a seismic damper according to aspects of the present invention can include any of a variety of configurations, features, shapes, and sizes. Accordingly, the features and configurations illustrated and described herein are not limited to use with any particularly sized, shaped or constructed seismic damper. Rather, each feature should be seen as being applicable for use with any other non-exclusive feature described herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A seismic damper, comprising:

a plate, wherein said plate comprises:

at least two opposing surfaces, wherein said at least two opposing surfaces have one or more perforations disposed therebetween;

a plurality of nodes, wherein each of said plurality of nodes is formed along a respective edge of said plate, and wherein each node of said plurality of nodes includes a narrowing portion of said plate, as said plate narrows between said one or more perforations and an edge surface in said plate; and a plurality of tabs, wherein each of said plurality of tabs intersects with at least two adjacent tabs at said plurality of nodes; and at least two tension straps mounted to said plate.

2. A seismic damper as recited in claim 1, wherein at least two opposing surfaces includes a first surface and a second surface, said first and second surfaces being substantially flat, and said one or more perforations extending fully between said first and second surfaces, and substantially perpendicular thereto.

3. A seismic damper as recited in claim 1, wherein said one or more perforations are fully internal and do not intersect any edge surface of said plate.

4. A seismic damper as recited in claim 1, wherein said at least two tension straps are parallel.

5. A seismic damper as recited in claim 1, wherein said at least two tension straps are nested and attached to said first surface.

6. A seismic damper as recited in claim 5, wherein said at least two tension straps mount to two tabs, the two tabs being the same for the at least two tension straps.

7. A seismic damper as recited in claim 6, wherein said at least two tension straps are different lengths.

8. A seismic damper as recited in claim 1, wherein said at least two tension straps mounted to said plate includes:

first and second tension straps mounted to a first surface of said two opposing surfaces; and third and fourth tension straps mounted to a second surface of said two opposing surfaces.

9. A seismic damper as recited in claim 8, wherein said first and second tension straps extend in a direction substantially perpendicular to a direction in which said third and fourth tension straps extend.

10. A seismic damper as recited in claim 1, wherein said at least two tension straps are arched when the seismic damper is not undergoing tension, and such that as said plate deforms due to a tensile load, said at least two tension straps straighten.

11. A seismic damper as recited in claim 1, wherein said plate further comprises at least two plate segments secured together, and such that a first of said two opposing surfaces is on a first plate segment, and a second of said two opposing surfaces is on a second plate segment.

12. A seismic damper comprising:

a substantially flat perforated member, wherein said substantially flat perforated member is adapted to attach to an intersection of two or more diagonal braces, said substantially flat perforated member defining:

one or more perforations formed in, and extending at least partially through said substantially flat perforated member, said one more perforations being centered around a center of said substantially flat perforated member;

a plurality of cut-outs along edges of said substantially flat perforated member; and a tab at each corner of said substantially flat perforated member, each of said tabs intersecting with two adjacent tabs at a node, wherein each of said tabs is configured to be attached to at least one of said two or more diagonal braces; and at least two diagonal tension members secured to said substantially flat perforated member.

13. A seismic damper as recited in claim 12, wherein said one or more perforations includes a plurality of perforations in said substantially flat perforated member, such that said nodes separating said tabs are external nodes, and wherein said substantially flat perforated member further includes internal nodes between said plurality of perforations.

14. A seismic damper as recited in claim 12, wherein said substantially flat perforated member exhibits delayed stiffening behavior during tensile loading.

15. A seismic damper as recited in claim 14, wherein said delayed stiffening behavior includes a first and second linear deformation regions and first and second yielding regions.

16. A seismic damper as recited in claim 15, wherein said second linear deformation region generally corresponds to a loading at which at least one of said at least two diagonal tension members is straightened under said loading.

17. A seismic damping system comprising:

at least one plate, wherein said at least one plate has a first surface and a second surface, wherein a distance between said first surface and said second surface defines a thickness of said at least one plate, and wherein said at least one plate further defines:

a plurality of interior apertures formed inside said at least one plate and extending fully through said thickness of said at least one plate;

a plurality of edge surfaces, wherein said edge surfaces each include at least one cut-out region extending fully through said thickness of said plate;

a plurality of tabs, wherein each tab is formed at a corner of said plate, and proximate an intersection of two edge surfaces;

an external node between each adjacent tab of said plurality of tabs; and internal nodes between said plurality of interior apertures, wherein said external nodes and said interior nodes are configured such that when a load is transferred to said plate from a structure, said load transferred to said flat plate is concentrated substantially at said internal and external nodes;

a first arched tension strap having a first surface, said first arched tension strap being attached to said first surface of said plate and to each of two non-adjacent tabs;

a second arched tension strap having a second surface, said second arched tension strap being attached to said second surface of said plate and to each of two non-adjacent tabs;

a third tension strap positioned proximate to said first surface of said first arched tension strap is attached to said first surface of said plate and to said two non-adjacent tabs to which said first arched tension strap is attached; and a fourth tension strap positioned proximate to said second surface of said second arched tension strap is attached to said second surface of said plate and to said two non-adjacent tabs to which said second arched tension strap is attached.

18. A seismic damping system as recited in claim 17, wherein said first arched tension strap and said second arched tension strap are configured to be attached to a plurality of cross-member supports of said structure.

19. A seismic damping system as recited in claim 17, wherein said first surface of first arched tension strap and said second surface of said second arched tension strap are opposing surfaces.

20. A seismic damping system as recited in claim 17, wherein:

said two non-adjacent tabs to which said first arched tension strap is attached are both different than said two non-adjacent tabs to which said second arched tension strap is attached.

* * * * *